US008291838B2

(12) United States Patent
Apps

(10) Patent No.: US 8,291,838 B2
(45) **Date of Patent: *Oct. 23, 2012**

(54) REINFORCED PALLET

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 1448 days.

This patent is subject to a terminal disclaimer.

(21) Appl. No.: 11/252,478

(22) Filed: Oct. 17, 2005

(65) Prior Publication Data

US 2006/0032414 A1 Feb. 16, 2006

Related U.S. Application Data

(63) Continuation of application No. 10/040,099, filed on Oct. 19, 2001, now Pat. No. 6,955,128.

(51) Int. Cl.
*B65D 19/38* (2006.01)

(52) U.S. Cl. ..... 108/57.25

(58) Field of Classification Search ..... 108/57.25, 108/902, 56.1, 57.33, 56.3, 901, 57.24, 51.11, 108/57.31

See application file for complete search history.

(56) References Cited

U.S. PATENT DOCUMENTS 1,770,614 A * 7/1930 Hennessy ..... 108/57.25
3,580,190 A * 5/1971 Fowler ..... 108/57.25
3,699,901 A * 10/1972 Cook, III ..... 108/57.25
5,117,762 A * 6/1992 Shuert ..... 108/57.25
5,413,052 A * 5/1995 Breezer et al. ..... 108/57.25
5,791,262 A * 8/1998 Knight et al. ..... 108/57.25
5,868,080 A * 2/1999 Wyler et al. ..... 108/57.25
5,894,803 A * 4/1999 Kuga ..... 108/57.25
6,125,770 A * 10/2000 Brandenburg ..... 108/57.25
6,199,488 B1 * 3/2001 Favaron et al. ..... 108/57.25
6,357,366 B1 * 3/2002 Frankenberg ..... 108/57.25
6,446,563 B1 * 9/2002 Ohanesian ..... 108/57.25
6,748,876 B2 * 6/2004 Preisler et al. ..... 108/57.25
6,955,128 B2 * 10/2005 Apps ..... 108/57.25

OTHER PUBLICATIONS

Definition of "sheet", Merriam-Webster OnLine, www.m-w.com/dictionary/sheet.*

* cited by examiner

*Primary Examiner* — Jose V Chen

(74) *Attorney, Agent, or Firm* — Carlson, Gaskey & Olds

(57) ABSTRACT

A reinforced pallet assembly having a first pallet deck and a second pallet deck. Each of the decks has an outer member and an intermediate member, each outer member and intermediate member having a one of a pair of mating cross-rib surfaces which are mounted together to define box-beam sections within each pallet deck. Also included is an elongate reinforcement member which is disposed between the outer member and the intermediate member of the second pallet deck for providing stiffness thereto. Further included is a plurality of columns which extend between the intermediate members.

12 Claims, 34 Drawing Sheets

REINFORCED PALLET

CROSS-REFERENCE TO RELATED APPLICATION

This application is a continuation of application U.S. Ser. No. 10/040,099, filed on Oct. 19, 2001 now U.S. Pat. No. 6,955,128.

BACKGROUND OF THE INVENTION

1. Field of the Invention

The present invention relates to a reinforced pallet.

2. Background Art

Pallets are subject to many types of loads and forces. Many of these loads and forces are illustrated by pallet racking scenarios and line load scenarios. The line load is the weight of a unit load concentrated along a narrow area across the full length or width of the pallet. The rack load is the load carrying capacity and deflection of a pallet which is supported by a rack frame near the ends of the pallet stringers.

Today, the use of plastic pallets is becoming more common. While reinforced plastic pallets presently exist, most do not provide sufficient reinforcement for racking loads and line loads. For example, a non-continuous, multiple piece cross-reinforcement may do little to support racking loads.

Some reinforced pallets today may attempt to handle various load types, such as line loads and racking loads, but are ultimately not size efficient or cost efficient. In other words, these pallets may not provide the end user with the desired strength and load bearing properties for the desired pallet package height. For example, in certain reinforced plastic pallets, the deck in which the reinforcement is located may be significantly larger than its unreinforced counterparts. In such a reinforced deck, the reinforcements may overlap in different planes, resulting in a larger deck height, and an overall larger pallet height.

Moreover, many reinforced pallets have reinforcement which is exposed. This is a particularly undesirable feature in the case where the reinforcement is made from fiberglass or other fiber material, which may eventually delaminate and cause the pallet to have less durability and a shorter pallet life.

Pallets formed of molded plastic material have distinct advantages over those made of wood or metal. While wood pallets have sufficient stiffness, they are heavy; are subject to warpage, splintering and splitting; are nonuniform in strength; and gain significant weight when wet. Metallic pallets typically are expensive and, in the case of steel, heavy and subject to corrosion. Plastic pallets are stronger, lighter and more durable than wooden pallets. Traditionally, fire retardance as it relates to plastic pallets has not been recognized as an issue. However, recently, plastic pallets have been the subject of standards promulgated by the National Fire Protection Association (NFPA), Underwriters Laboratories Inc. (UL), Factory Mutual Research Company (FMRC), and National Association of Fire Marshals.

Some standards allow for plastic pallets to be used the same as wood pallets when experimental data show equivalency in the burning and suppression characteristics between the plastic and wood pallets. Unfortunately, some material presently used to help promote fire retardance in plastic pallets, such as an engineered resin blend of high-impact polystyrene and polyphenylene oxide, is very expensive and thus not cost efficient to mold an entire pallet from this material. Such material may also not be as injection-molding friendly as other polymeric materials.

Accordingly, a reinforced plastic pallet is desired which is capable of handling the various loads to which a pallet may be subjected, including both line loads and racking loads. The pallets should have a package height comparable to an unreinforced pallet. The pallet and reinforcement should also be durable, provide for improved pallet life, and should be cost efficient. Moreover, a pallet is desired which is accepted by the fire community as having burn and suppression properties substantially similar or better than wood, is relatively inexpensive, lightweight, and easy to manufacture.

SUMMARY OF THE INVENTION

It is an object according to the present invention to provide a plastic pallet which is capable of accommodating both line loading and rack loading.

It is another object according to the present invention to provide a plastic pallet with reinforcement for providing improved strength and load supporting properties.

It is another object according to the present invention to provide a reinforced pallet which has is size efficient or which has a package height comparable to other plastic pallets.

It is yet another object according to the present invention to provide a reinforced pallet with improved durability and cost efficiency.

In carrying out the above objects according to the present invention, provided is a reinforced pallet assembly having a first pallet deck and a second pallet deck. Each of the decks has an outer member and an intermediate member, each outer member and intermediate member having a one of a pair of mating cross-rib surfaces which are mounted together to define box-beam sections within each pallet deck. Also included is a reinforcement member which is disposed between the outer member and the intermediate member of the second pallet deck for providing stiffness thereto. Further included is a plurality of columns which extend between the intermediate members. The first and second pallet decks and columns may a plastic material and the at least one reinforcement member may comprise a metal material. Also, the columns include a first column portion projecting from the first intermediate portion, and a second column portion projecting from the second intermediate portion and attached to the first column portion. The second pallet deck may be defined by a unitary construction comprising a plurality of peripheral rail members and at least one cross-rail extending between a pair of peripheral rail members. The reinforcement member may be disposed within the cross-rail or within the peripheral rail members of the second pallet deck. The second pallet deck includes a channel within which the reinforcement member is disposed.

The first pallet deck further may include a second reinforcement member disposed between the first outer member and the first intermediate member which is oriented generally perpendicular to the reinforcement member. The first pallet deck may include a second reinforcement member disposed therein extending substantially along its central axis.

Also provided according to the present invention is a pallet assembly which has a first pallet member having a first pallet surface including a first set of cross-rib members. A second pallet member is disposed adjacent the first pallet member and has a second pallet surface including a second set of cross-rib members corresponding to the first set. The first and second sets of cross-rib members are secured together to form a first pallet deck. The second pallet member also includes a mating surface opposite the second pallet surface. Also included is a first reinforcement member which is disposed between the first and second pallet members along a first axis thereof. A third pallet member is disposed adjacent the second pallet member and has a third pallet surface including a third set of cross-rib members. The third pallet member has an other mating surface opposite the third pallet surface. A fourth pallet member is disposed adjacent the third pallet member and has a fourth pallet surface including a fourth set of cross-rib members corresponding to the third set. The third and fourth sets are secured together to form a second pallet deck. A second reinforcement member is disposed between the third and fourth pallet members along a second axis thereof oriented substantially perpendicular to the first reinforcement member. A column portion extends between the third and fourth members.

Also provided according to this invention is a reinforced pallet having a top deck and a bottom deck and columns. The top deck has an upper surface, a lower surface, and a plurality of upper box beam sections between the upper and lower surfaces. The bottom deck has an upper surface, a lower surface, and a plurality of lower box beam sections between the upper and surfaces. The bottom deck further includes at least one elongate reinforcement member disposed therein, and a plurality of columns extending between and attached to the top deck and bottom deck.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 7:
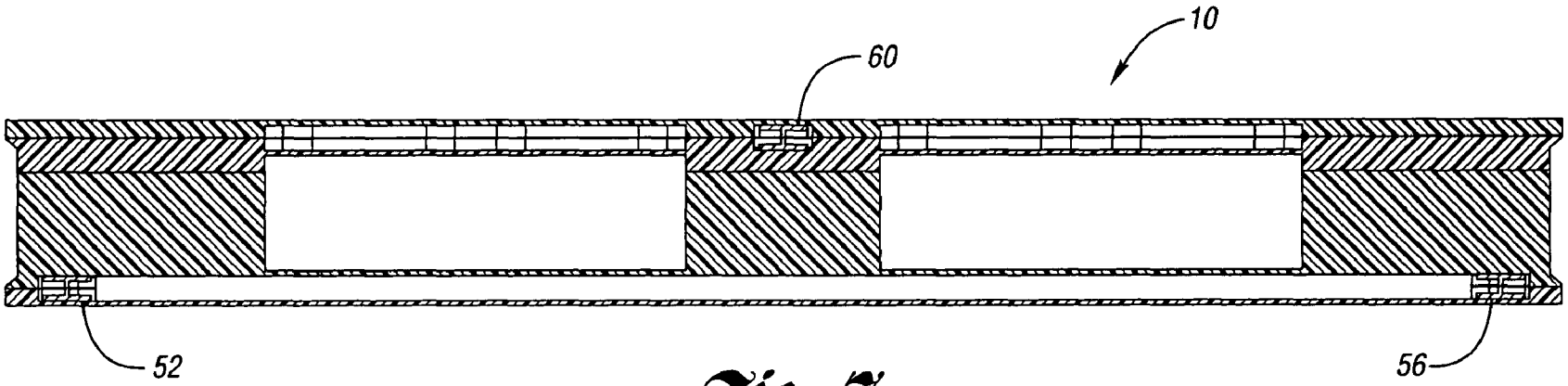
FIG. 7 is a cross-sectional view taken along line 7-7 of FIG. 2.
Figure 8:
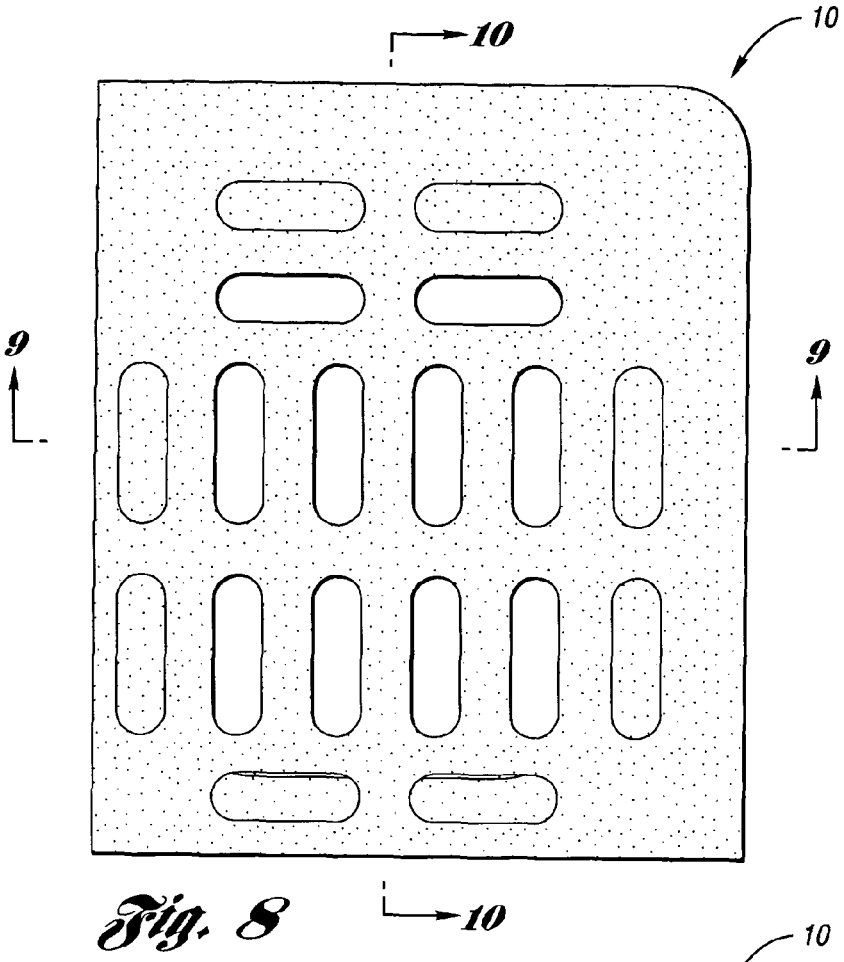
FIG. 8 is a quarter section of the first embodiment.

FIGS. 1-11 illustrate a reinforced pallet 10 according to a first embodiment of to the present invention. Pallet 10 includes a top (or upper) deck 12 and a bottom (or lower) deck 14. Top deck 12 and bottom deck 14 are formed having a box beam construction as illustrated in FIGS. 9*a* and 10*a*, and decks 12,14 are attached to each other to define pallet 10. More particularly, bottom deck 14 of pallet 10 has at least one reinforcement cross-member 50 disposed therein. As disclosed further herein, bottom deck 14 may also include peripheral reinforcement members. However, in accordance with the teachings of the present invention, the at least one reinforcement cross-member 50 is preferably not disposed around the periphery of bottom deck 14, but instead is distal from the periphery, and more preferably extends across and within the at least one of the longitudinal or transverse centerlines of bottom deck 14.

As best illustrated in FIGS. 9*a* and 10*a*, top deck 12 has a generally flat, planar upper surface 16 and in this embodiment also includes a lower surface 18 which is defined by a plurality of first column portions 20 (supports) which are shown as being integrally formed with top deck 12 in a unitary manner. Lower deck 14 includes a generally planar lower surface 22 and in this embodiment also includes an upper surface 24 defined by a plurality of second column portions 26 (supports) which are also shown as being integrally formed with bottom deck 14 in a unitary manner. Mating surfaces 18 and 24 mate with and attach to each other. More particularly, mating column portions 20, 26 are mounted to each other to complete a plurality of columns 28 (or blocks) extending between top deck 12 and bottom deck 14, of which there are generally nine columns: four columns at the corners, four columns being centrally located along the sides, and one column centrally located. Of course, as shown in later embodiments, the columns may be separate components or may be integrally molded to form a unitary construction with one of the decks.

Figure 1:
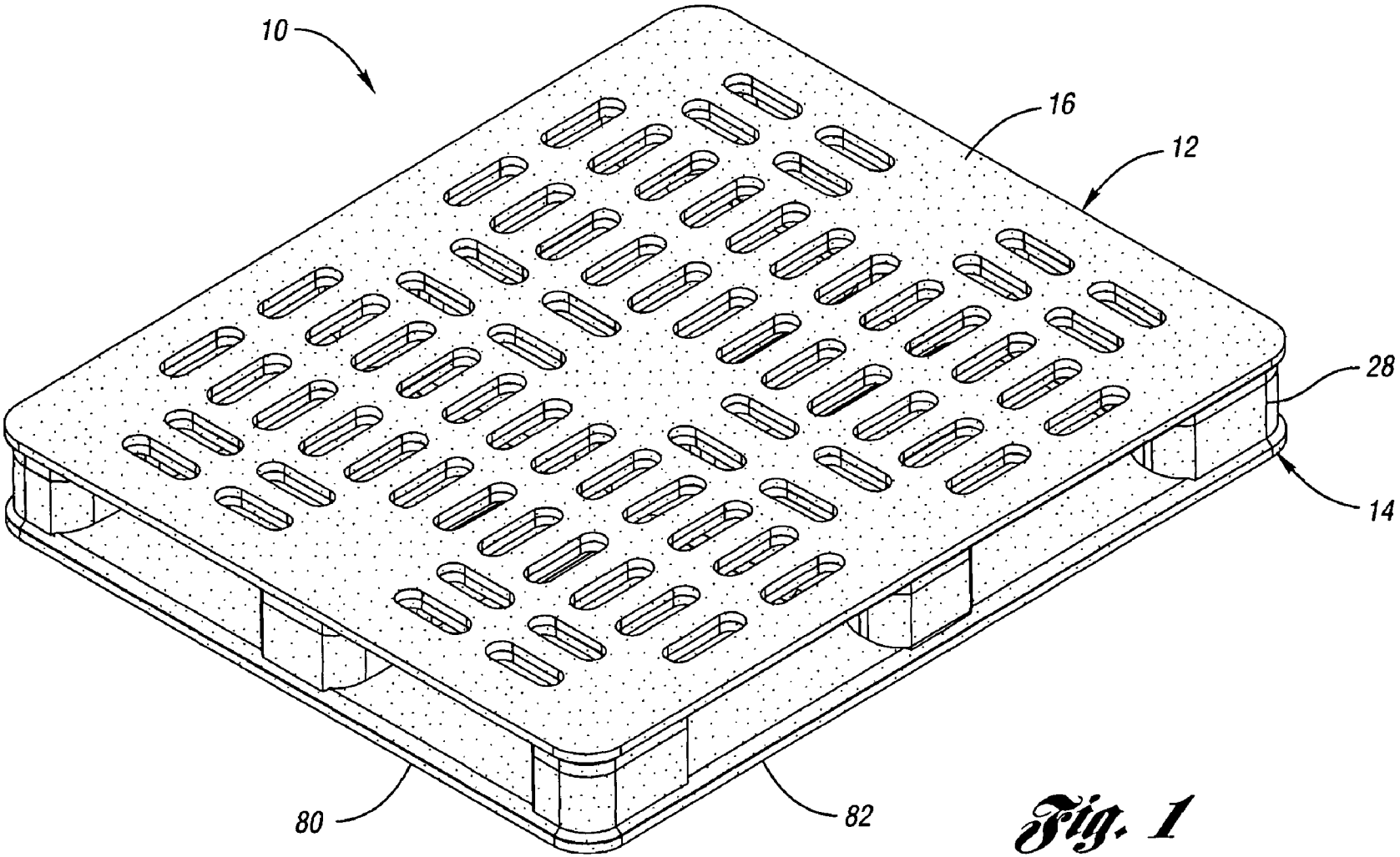
FIG. 1 is a perspective view of a first embodiment of a reinforced pallet according to the present invention.

FIG. 1 illustrates a perspective view of pallet 10, which includes top and bottom deck portions 12,14 which are preferably, but not necessarily, formed of a thermoplastic or other polymeric material via an injection molding process, and more particularly formed of a polypropylene material. Pallet 10 is shown as having a generally rectangular shape and also as being generally symmetrical about each center line. However, it is fully contemplated that pallet 10 and various shapes and configurations, and may also not be symmetrical about the centerline, without departing from the teachings according to the present invention. FIGS. 2, 3, 4 and 5 illustrate respectively a top plan view, bottom plan view, front elevational view and side elevational view of pallet 10. FIG. 7 is a partial cross-sectional view of pallet assembly 10 taken along line 7-7 of FIG. 6. FIG. 8 is a cross sectional view of the pallet assembly taken along line 8-8 of FIG. 6.

Figure 3:
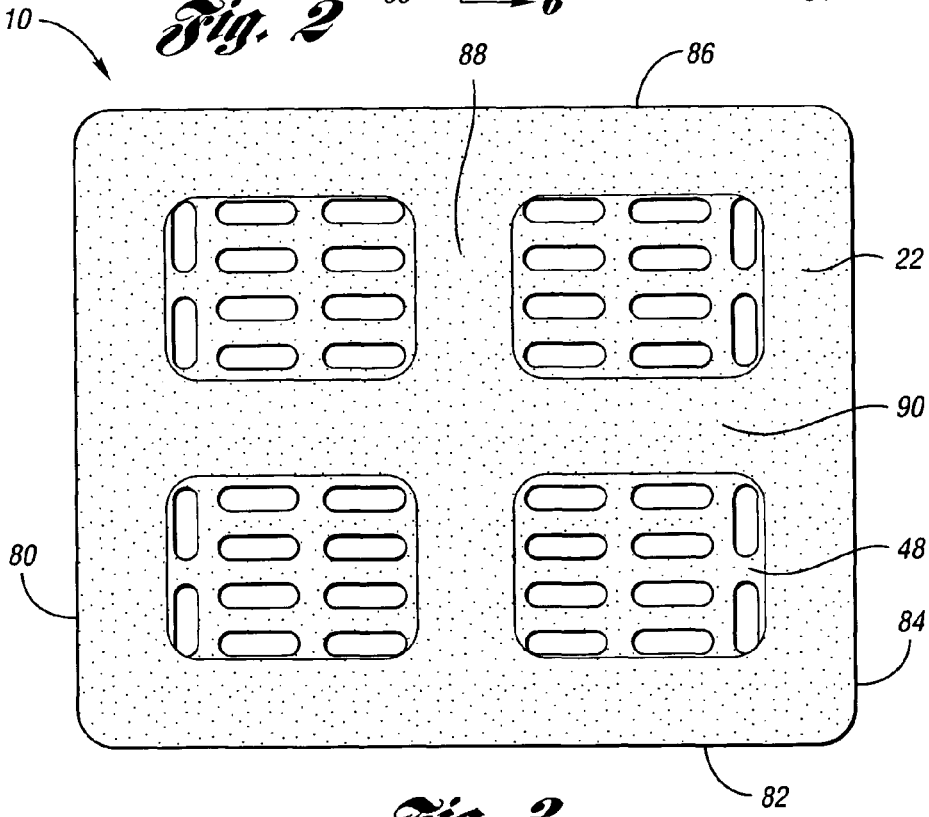
FIG. 3 is a bottom plan view of the first embodiment.
Figure 4:
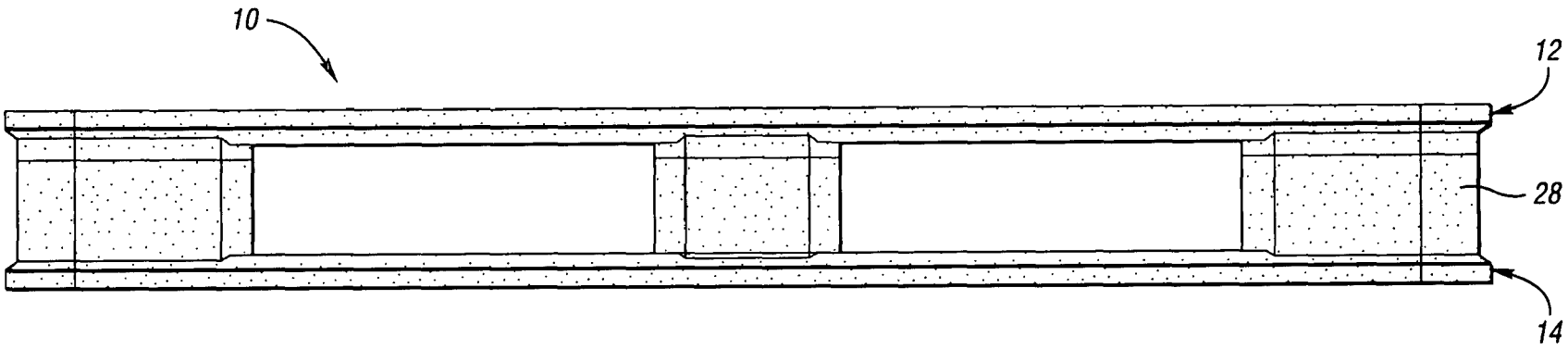
FIG. 4 is a front elevational view of the first embodiment, the rear elevational view being substantially a mirror image thereof.
Figure 5:
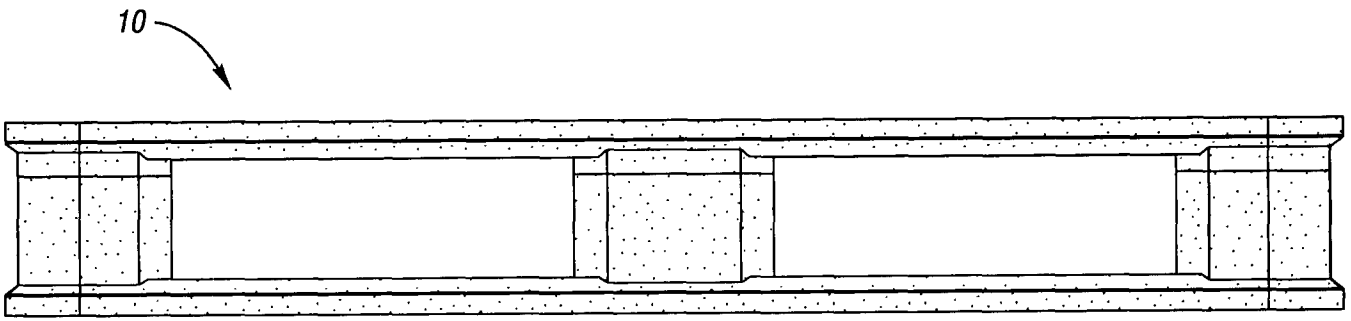
FIG. 5 is a left side elevational view of the first embodiment, the right side elevational view being substantially a mirror image thereof.
Figure 6:
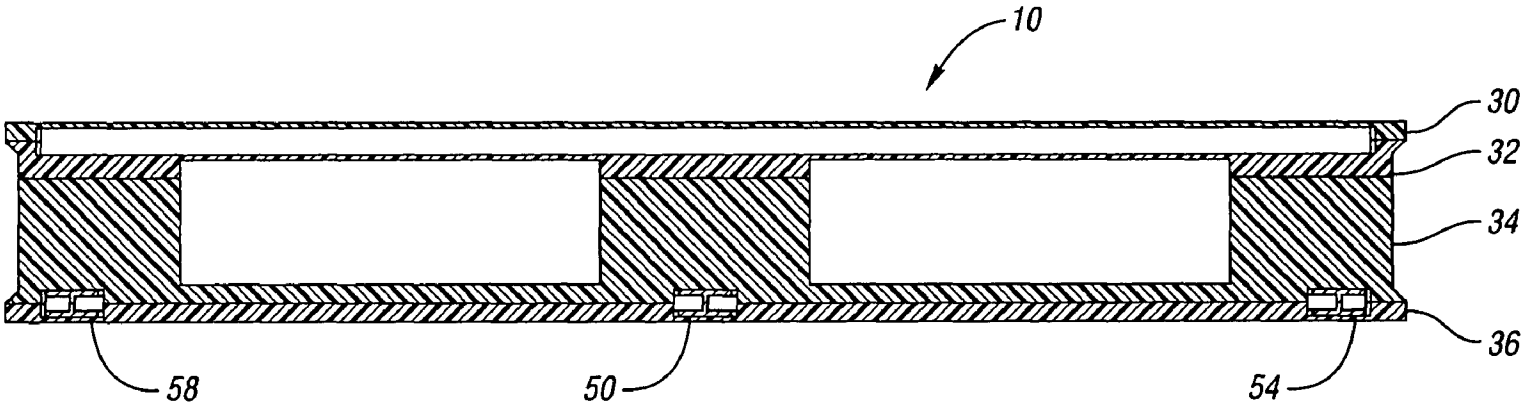
FIG. 6 is a cross-sectional view taken along line 6-6 of FIG. 2.
Figure 10:
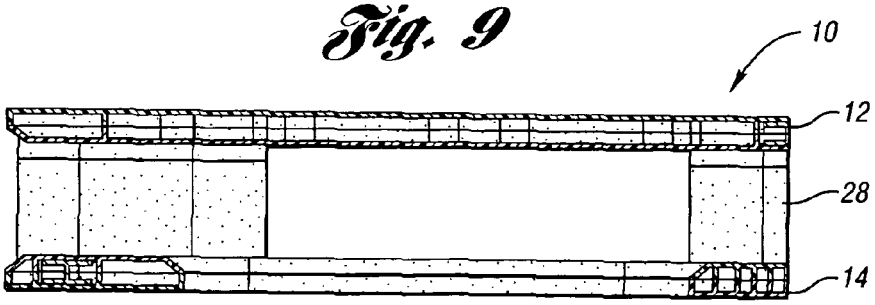
FIG. 10 is a cross-sectional view taken along line 10-10 of FIG. 8.
Figure 9A:
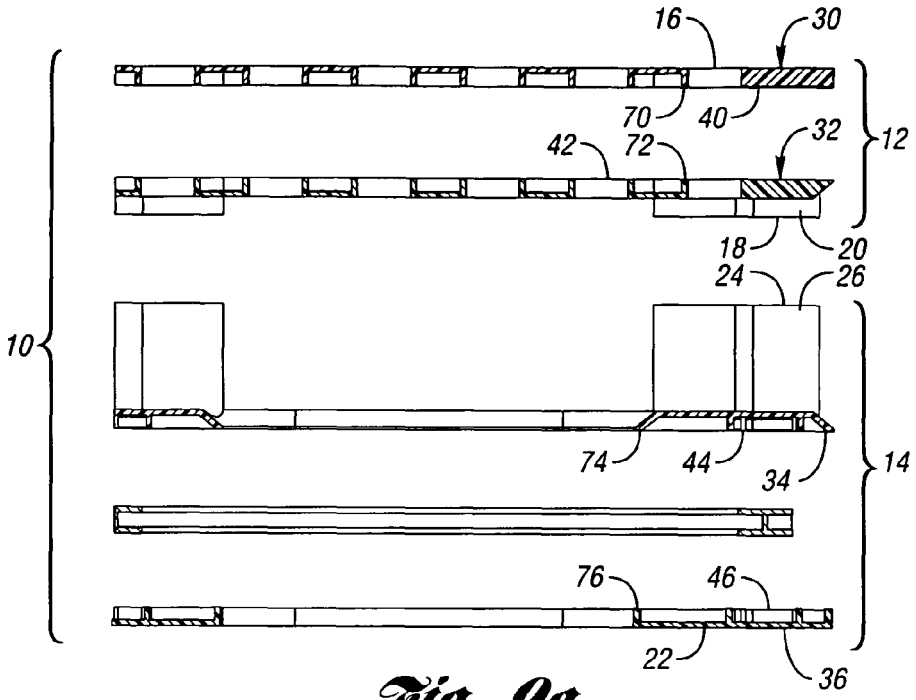
FIG. 9*a* is an exploded view of FIG. 9.
Figure 10A:
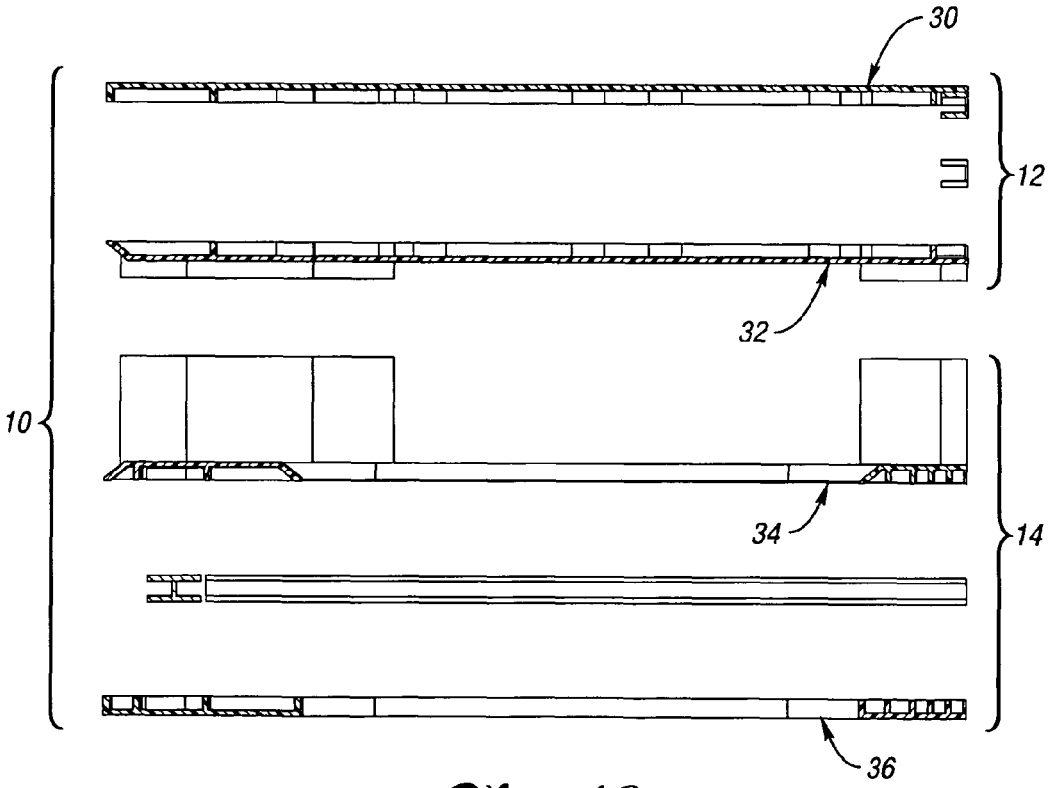
FIG. 10*a* is an exploded view of FIG. 10.
Figure 11:
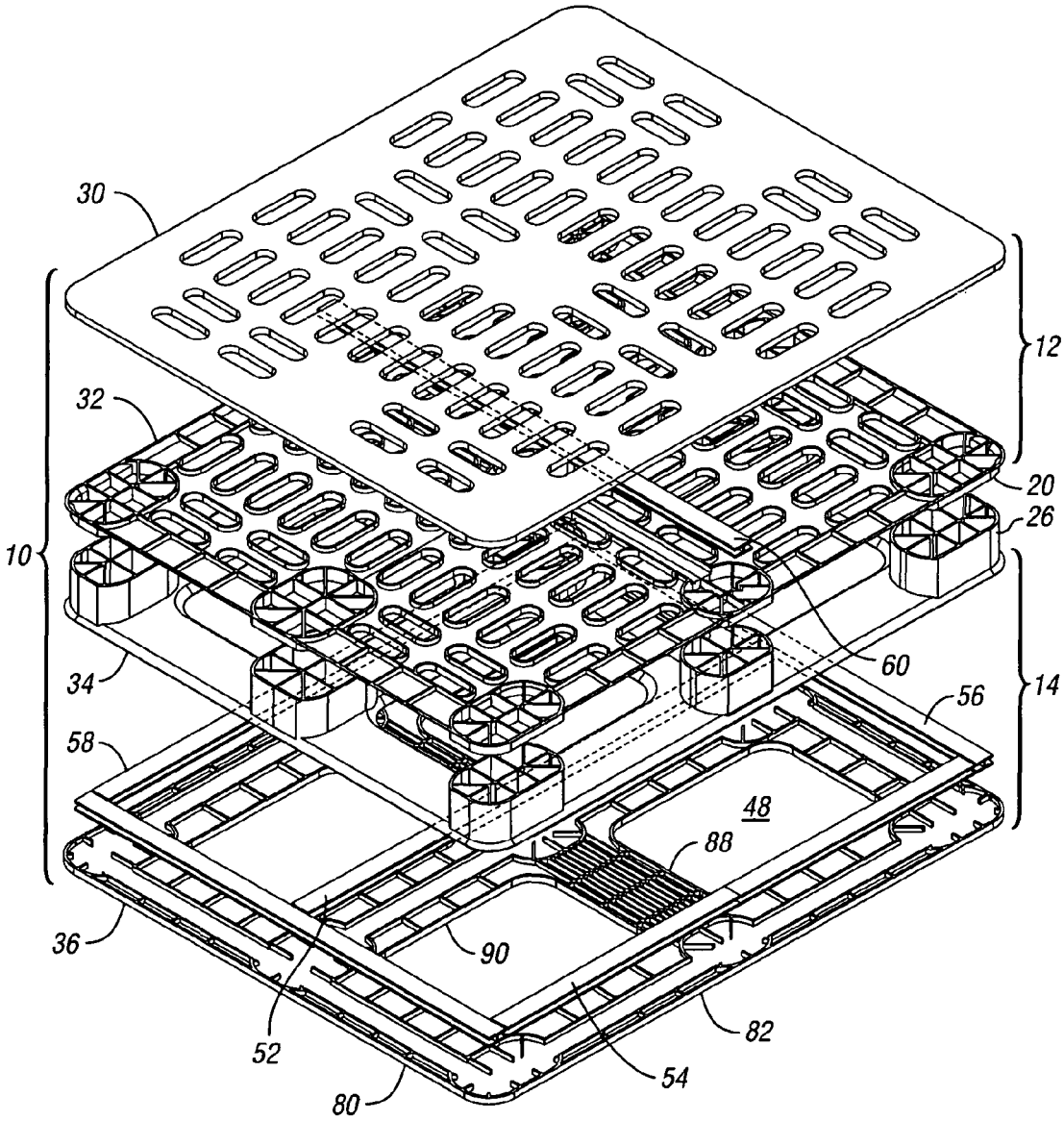
FIG. 11 is an exploded perspective view of FIG. 1, illustrating the reinforcement therein.
Figure 12:
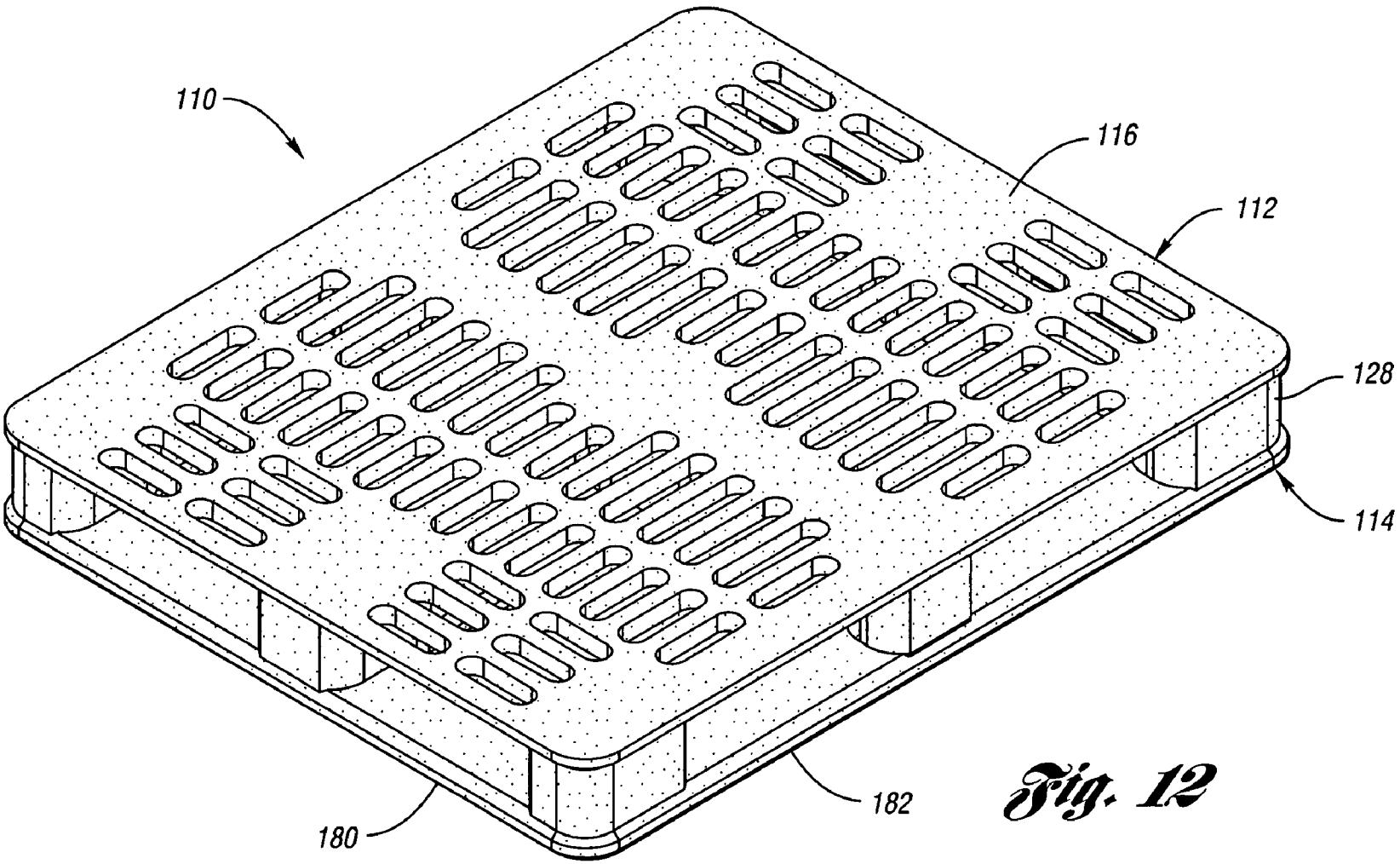
FIG. 12 is a perspective view of a second embodiment of a reinforced pallet according to the present invention.
Figure 13:
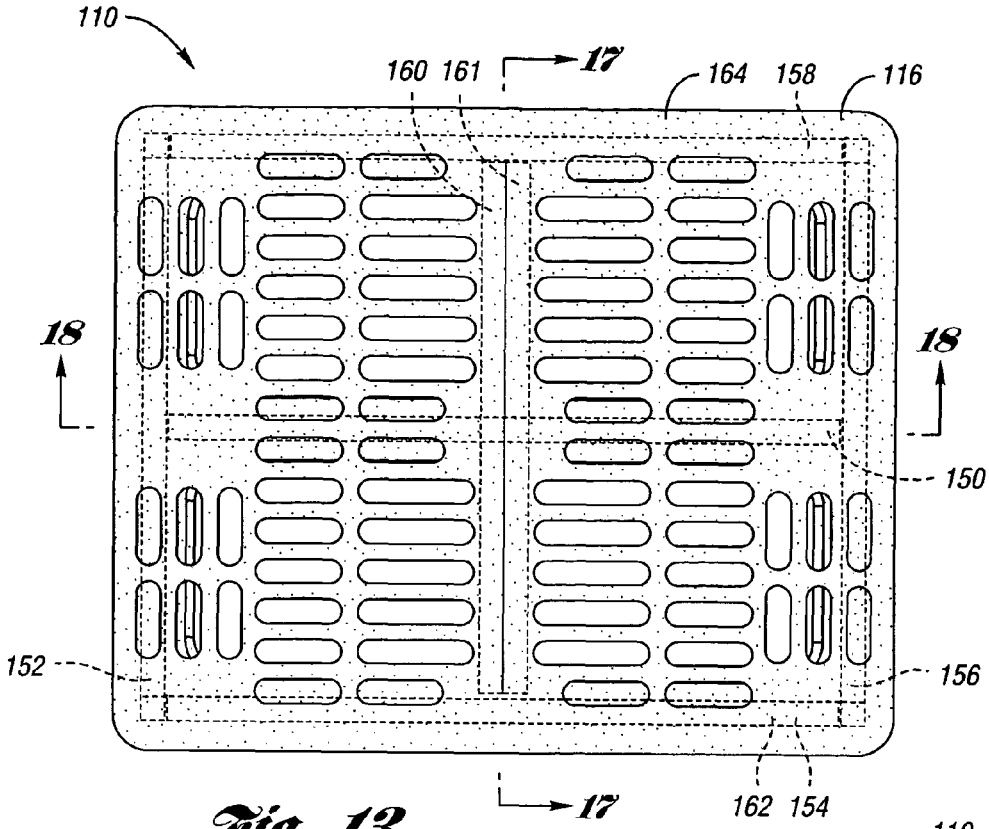
FIG. 13 is a top plan view of the second embodiment.
Figure 14:
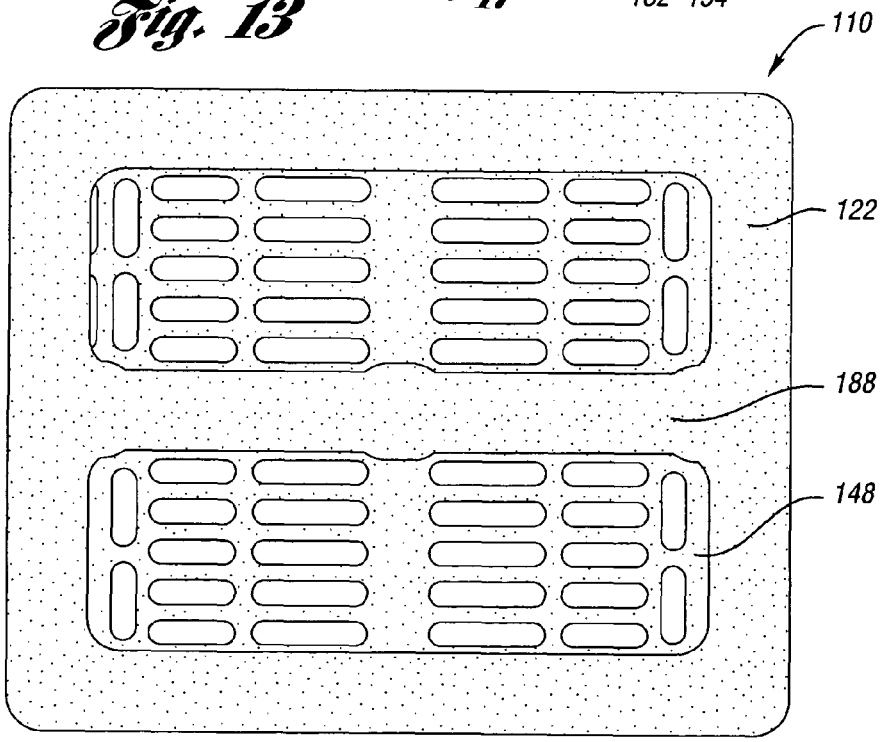
FIG. 14 is a bottom plan view of the second embodiment.
Figure 15:
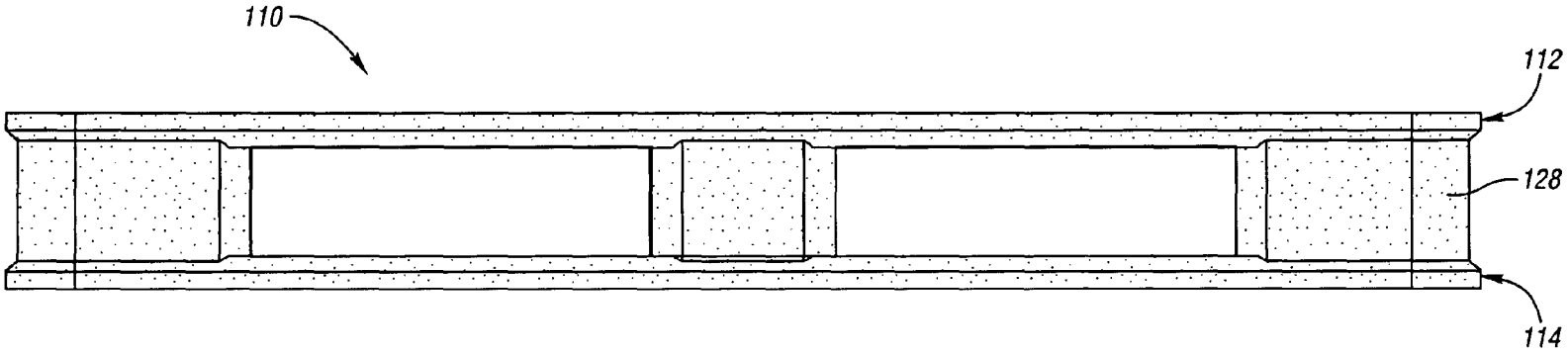
FIG. 15 is a front elevational view of the second embodiment, the rear elevational view being substantially a mirror image thereof.
Figure 16:
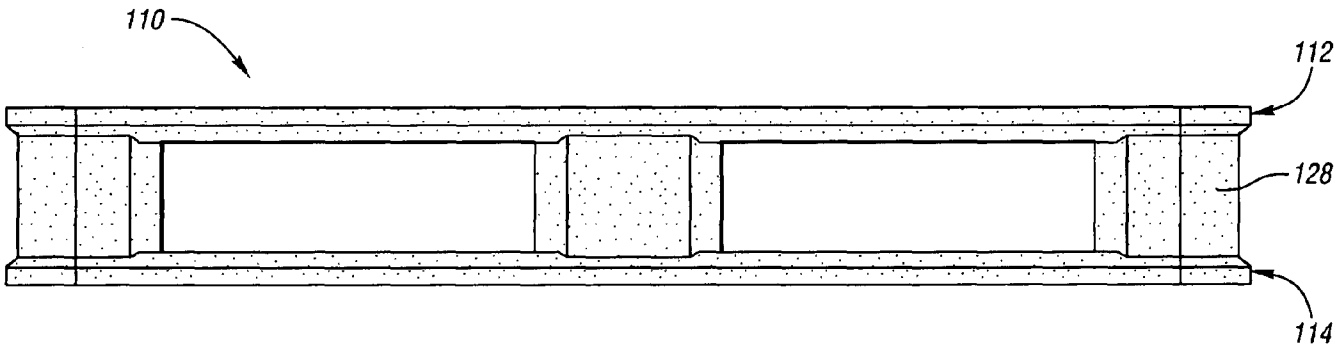
FIG. 16 is a left side elevational view of the second embodiment, the right side elevational view being substantially a mirror image thereof.
Figure 17:
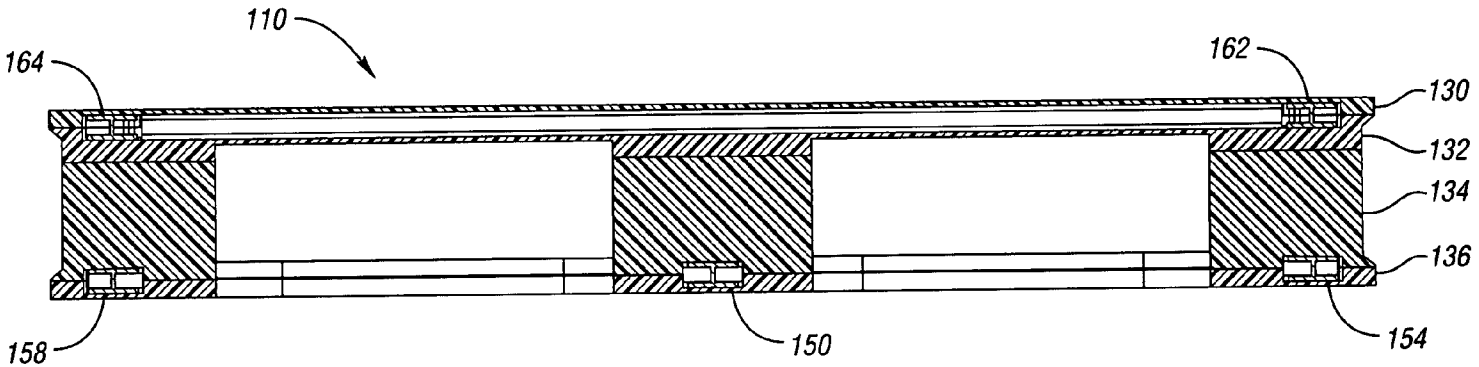
FIG. 17 is a cross-sectional view taken along line 17-17 of FIG. 2.
Figure 18:
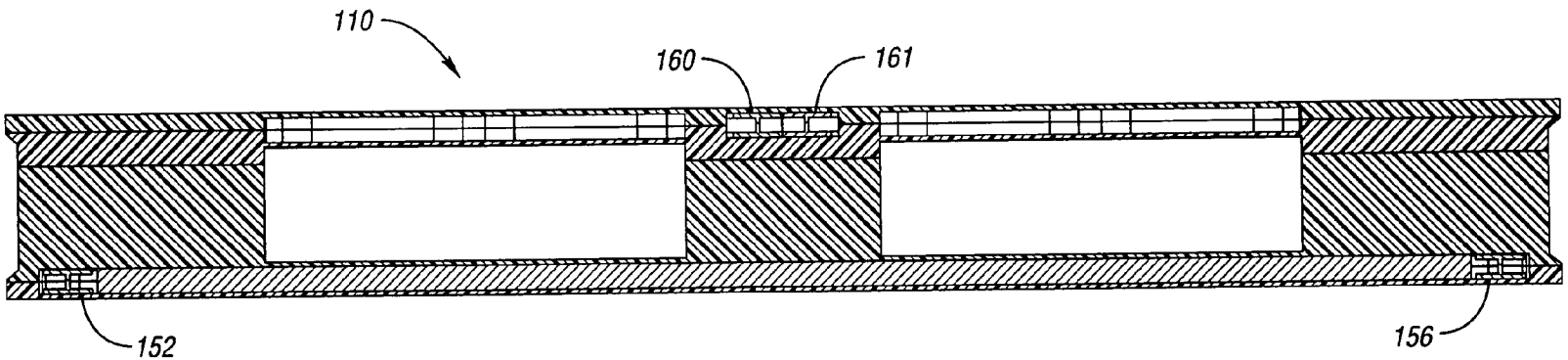
FIG. 18 is a cross-sectional view taken along line 18-18 of FIG. 2.
Figure 19:
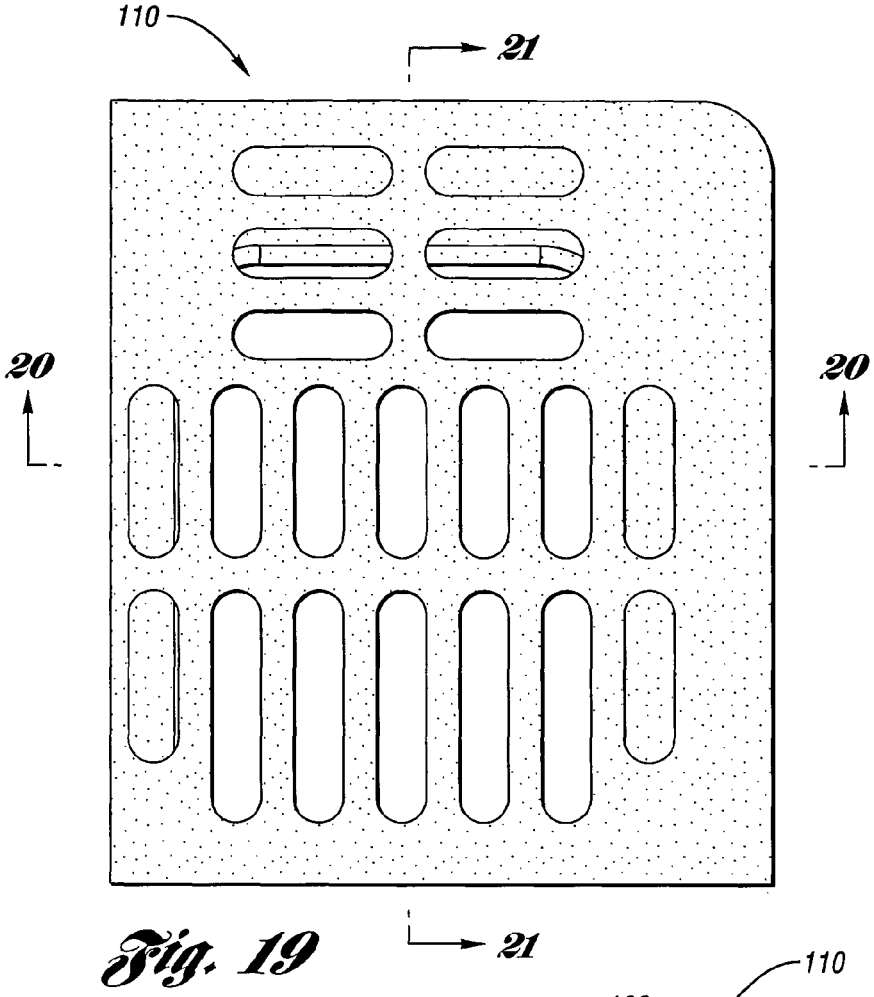
FIG. 19 is a quarter section of the second embodiment.
Figure 20:
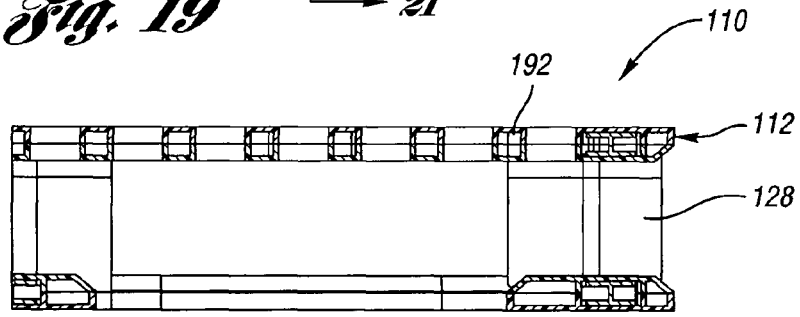
FIG. 20 is a cross-sectional view taken along line 20-20 of FIG. 19.
Figure 21:
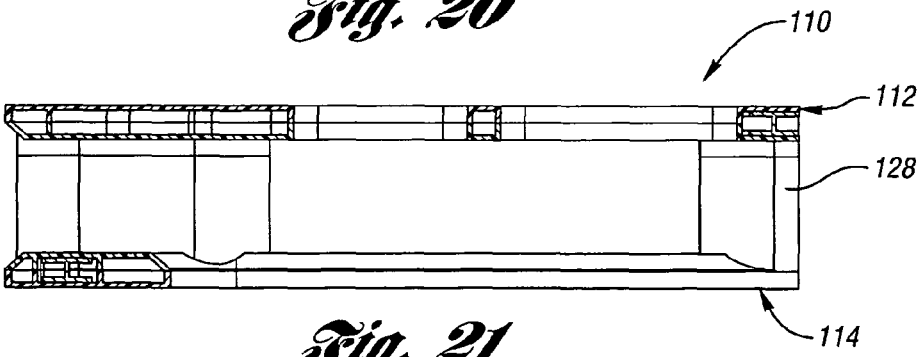
FIG. 21 is a cross-sectional view taken along line 21-21 of FIG. 19.
Figure 20A:
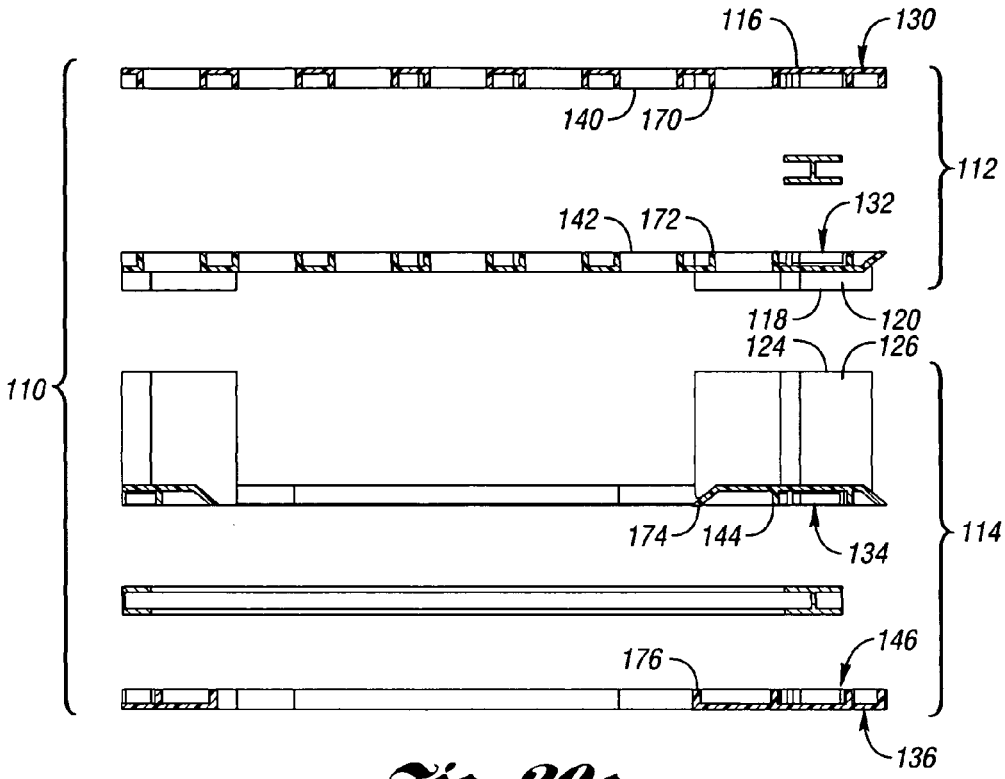
FIG. 20*a* is an exploded view of FIG. 20.
Figure 21A:
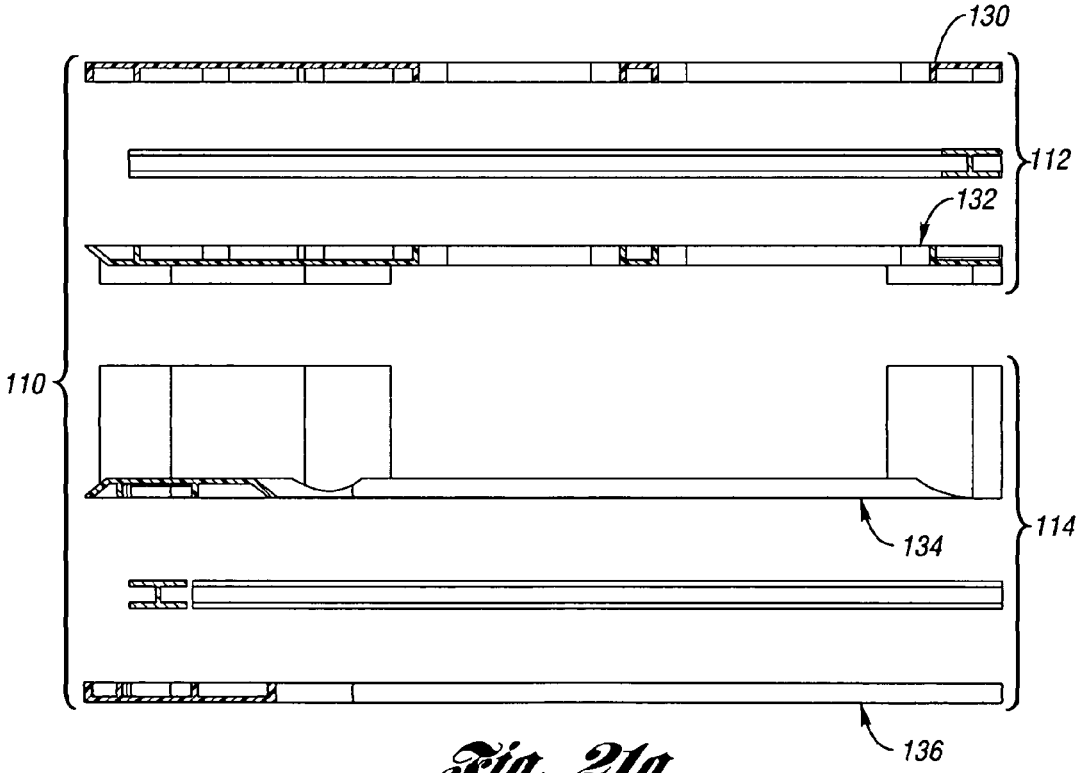
FIG. 21*a* is an exploded view of FIG. 21.
Figure 22:
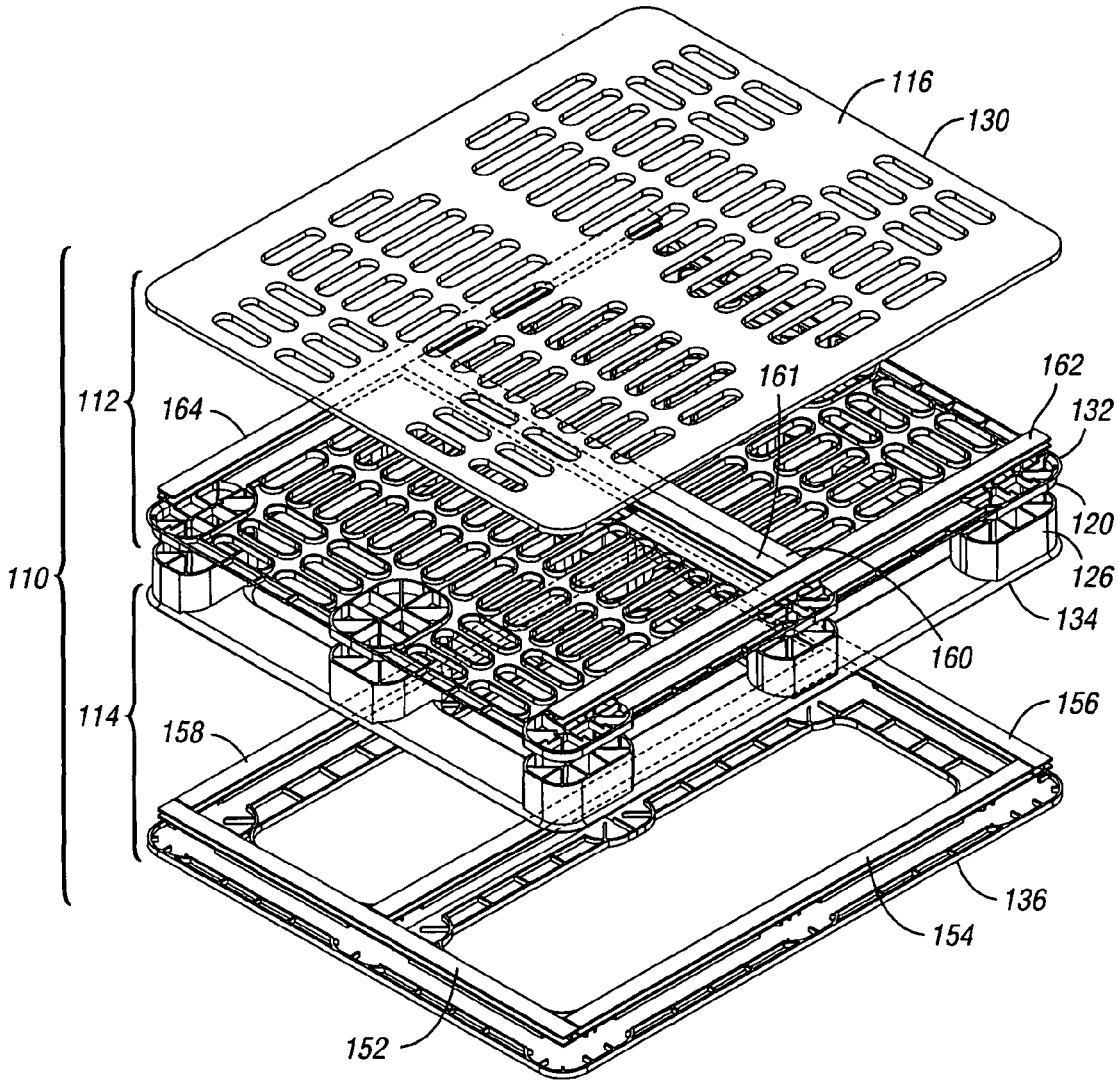
FIG. 22 is an exploded perspective view of FIG. 12, illustrating the reinforcement therein.
Figure 23:
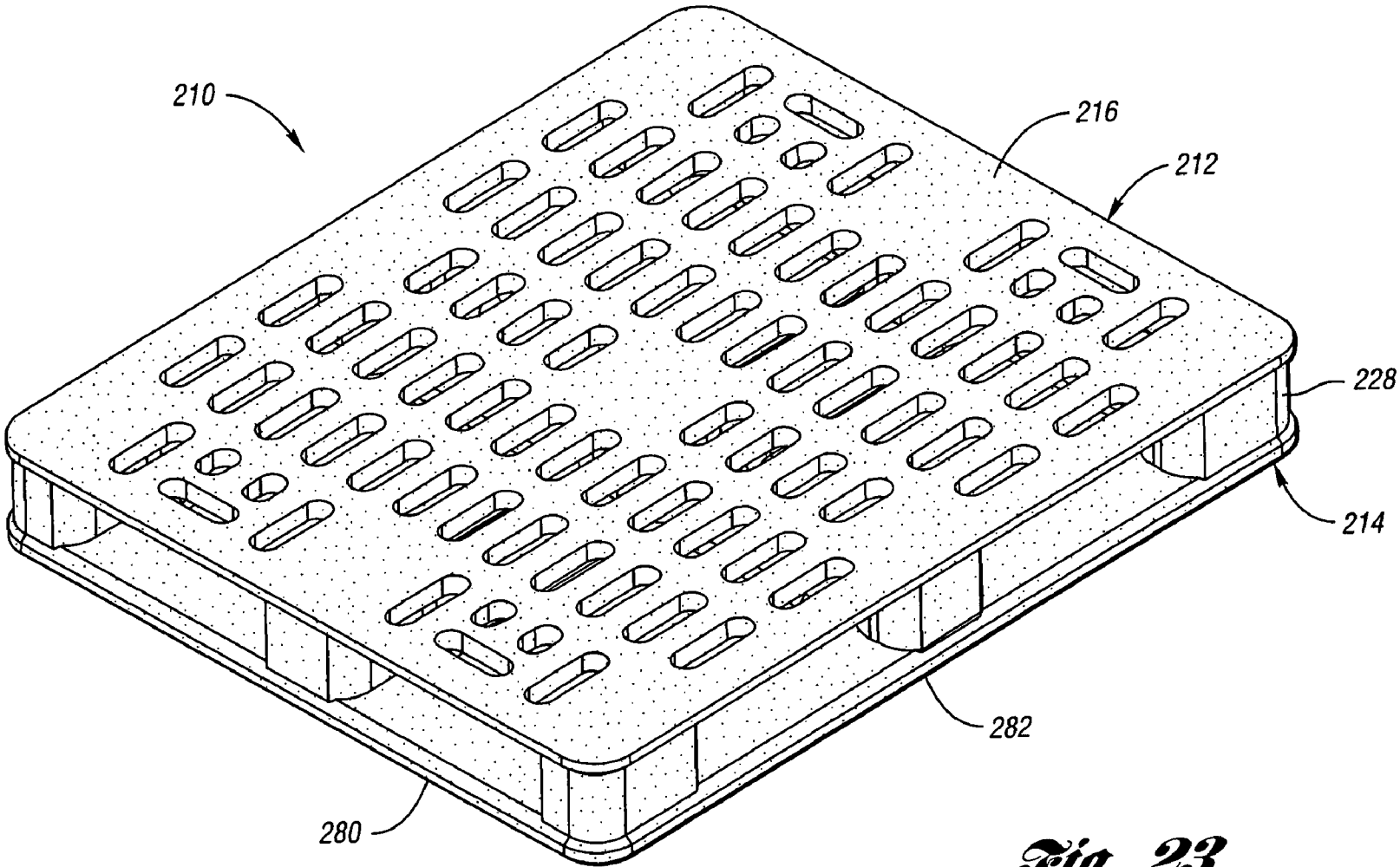
FIG. 23 is a perspective view of a third embodiment of a reinforced pallet according to the present invention.
Figure 24:
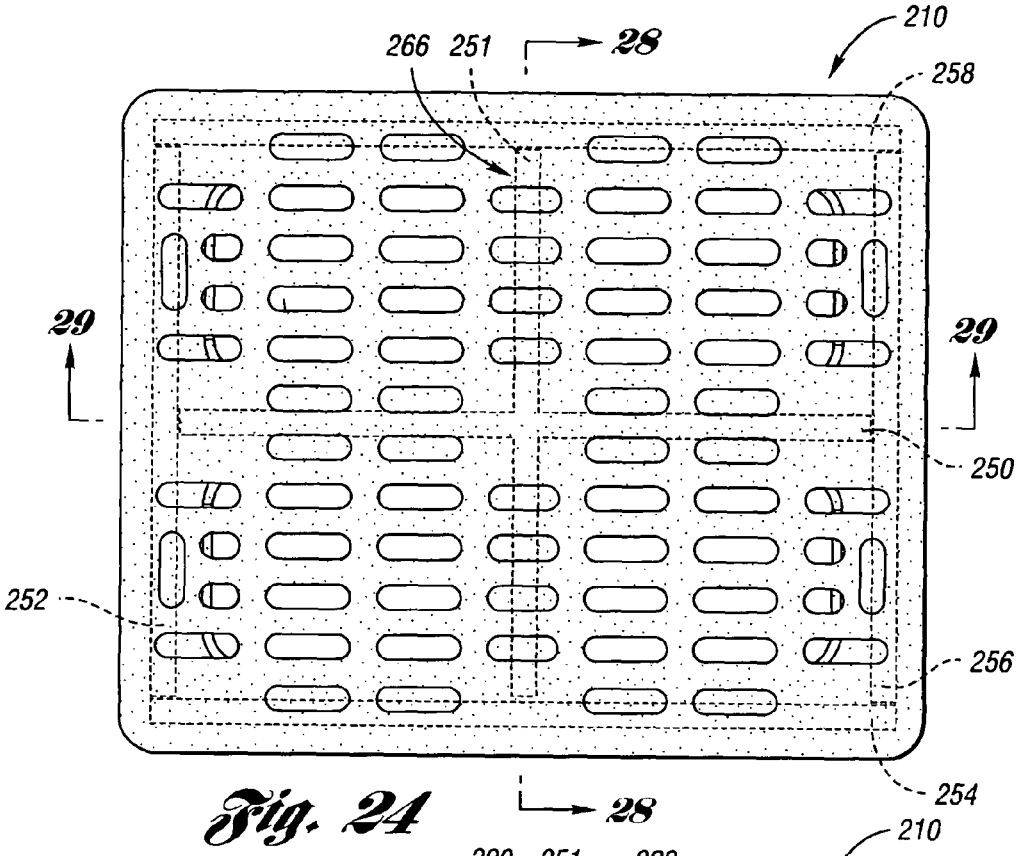
FIG. 24 is a top plan view of the third embodiment.
Figure 25:
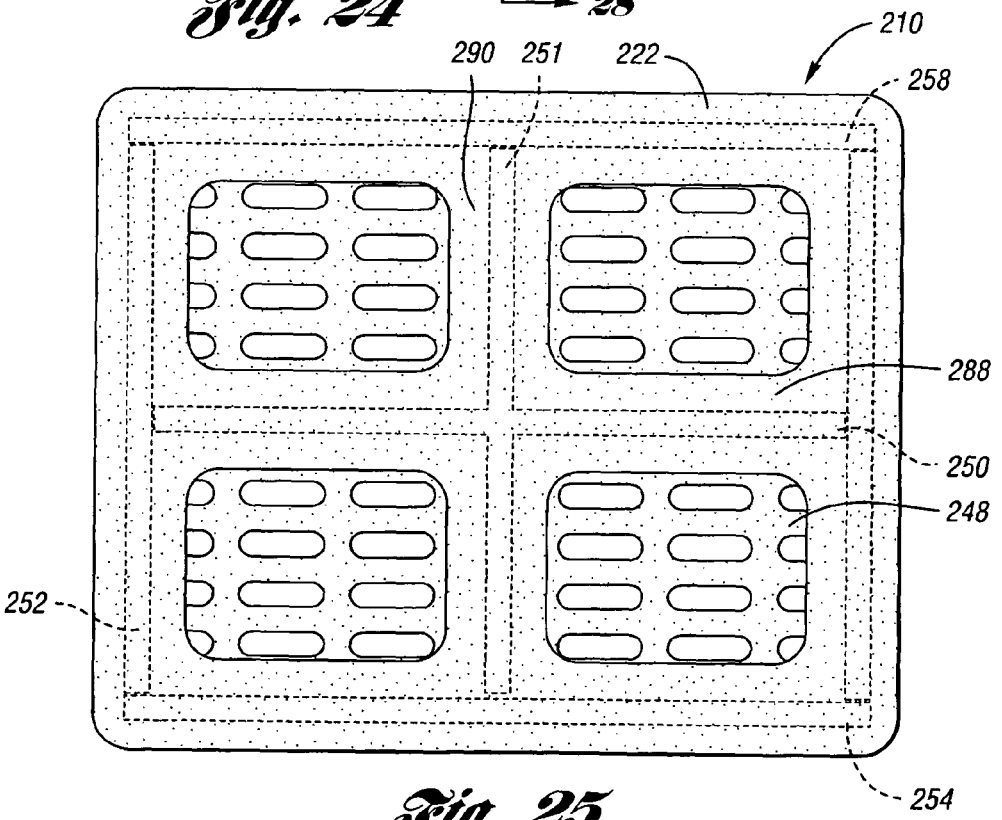
FIG. 25 is a bottom plan view of the third embodiment.
Figure 26:
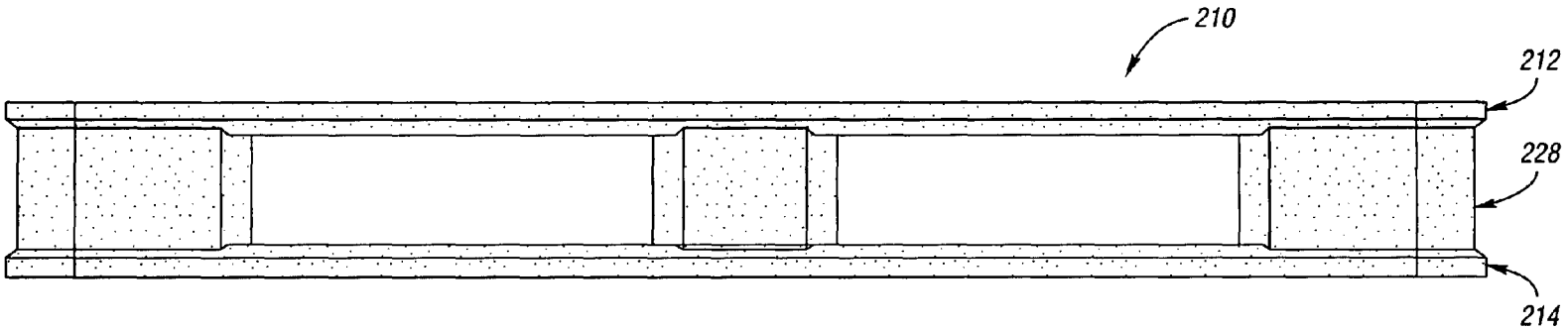
FIG. 26 is a front elevational view of the third embodiment, the rear elevational view being substantially a mirror image thereof.
Figure 27:
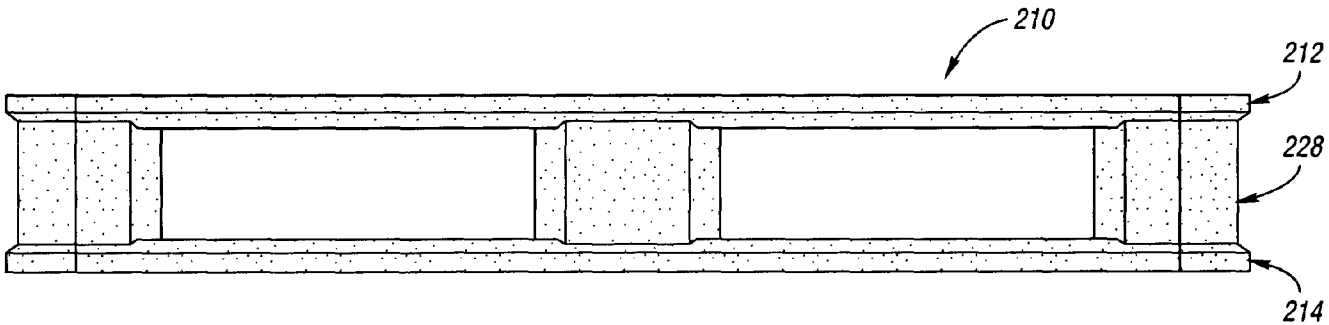
FIG. 27 is a left side elevational view of the third embodiment, the right side elevational view being substantially a mirror image thereof.
Figure 28:
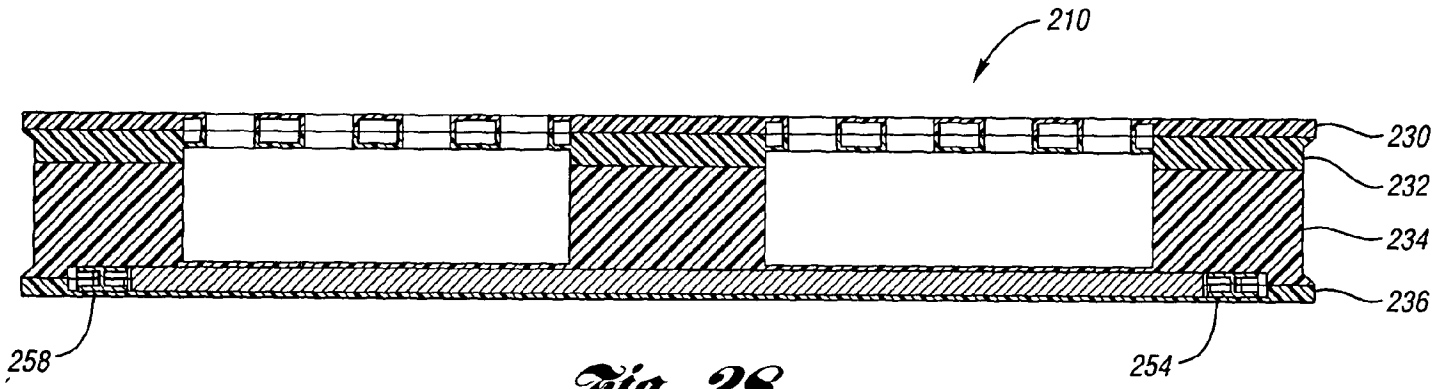
FIG. 28 is a cross-sectional view taken along line 28-28 of FIG. 24.
Figure 29:
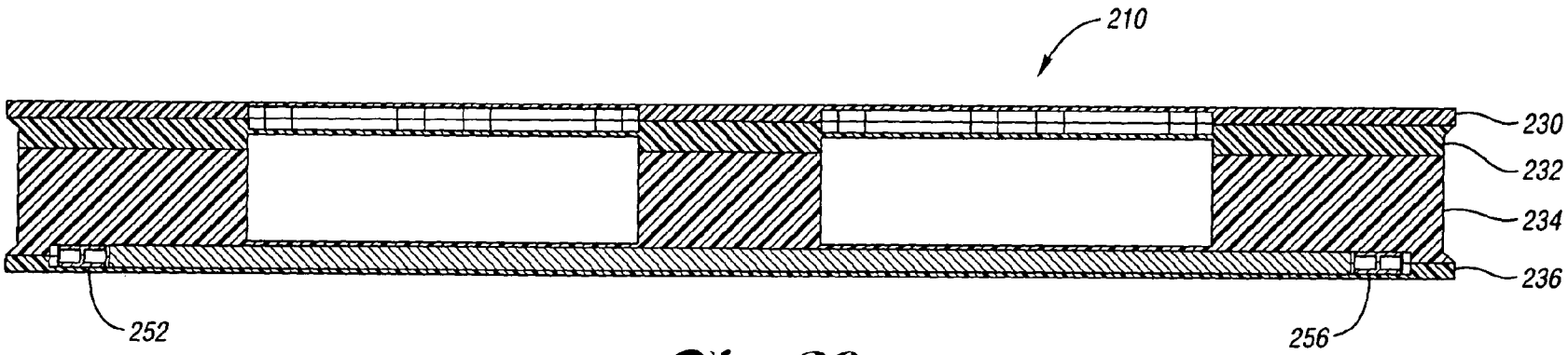
FIG. 29 is a cross-sectional view taken along line 29-29 of FIG. 24.
Figure 30:
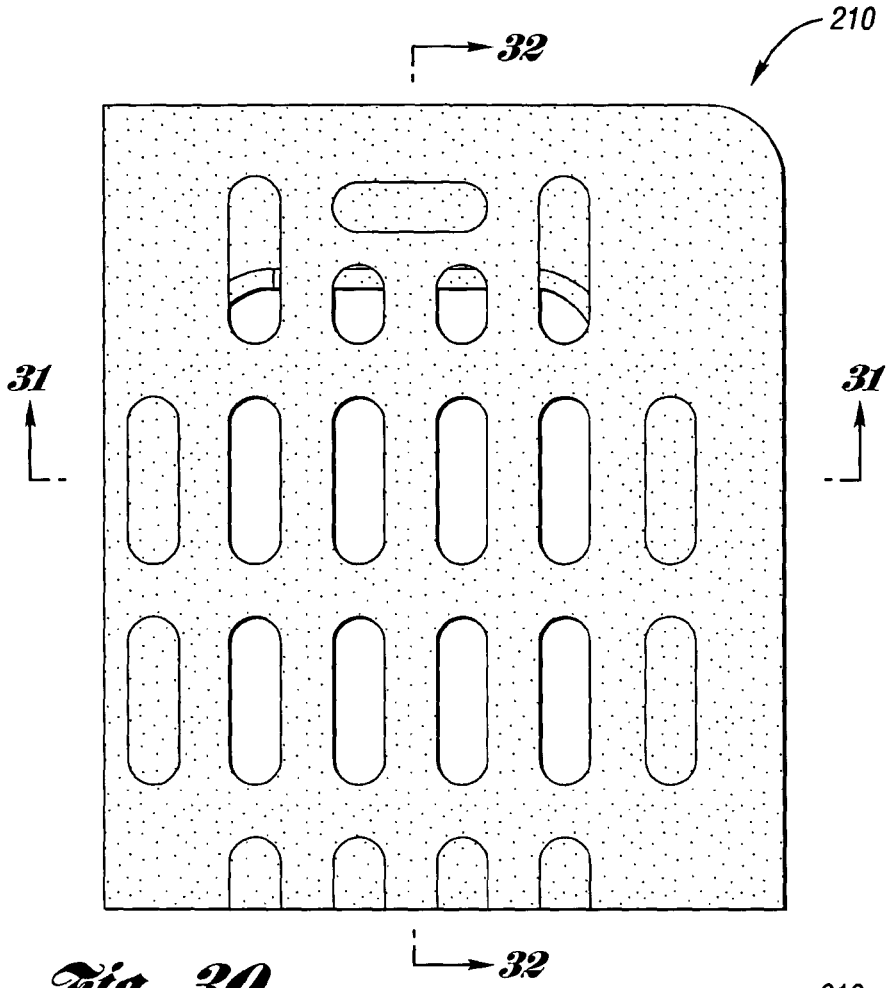
FIG. 30 is a quarter section of the third embodiment.
Figure 31:
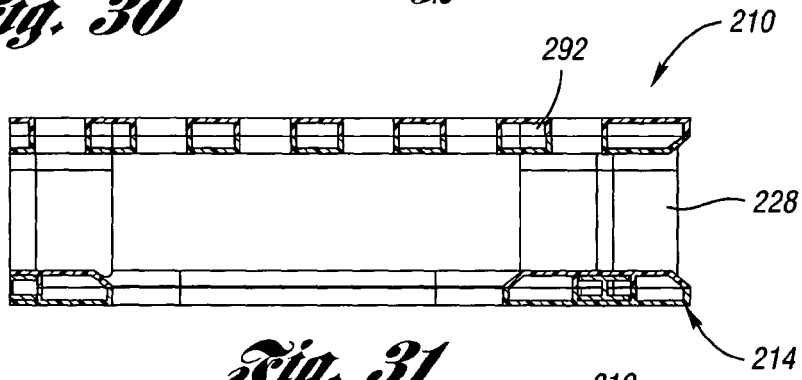
FIG. 31 is a cross-sectional view taken along line 31-31 of FIG. 30.
Figure 32:
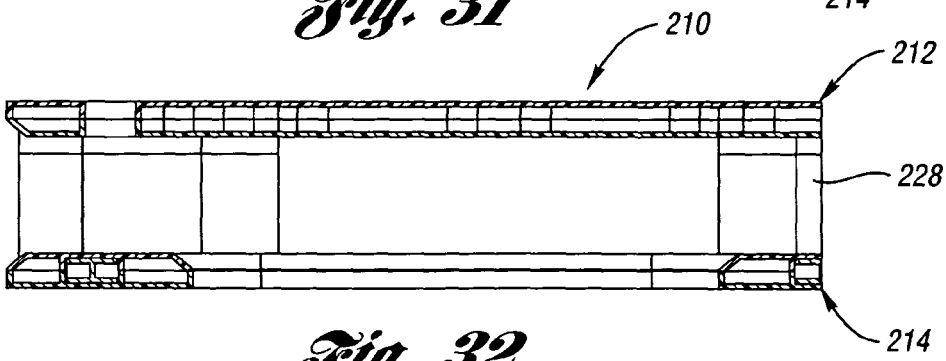
FIG. 32 is a cross-sectional view taken along line 32-32 of FIG. 30.
Figure 31A:
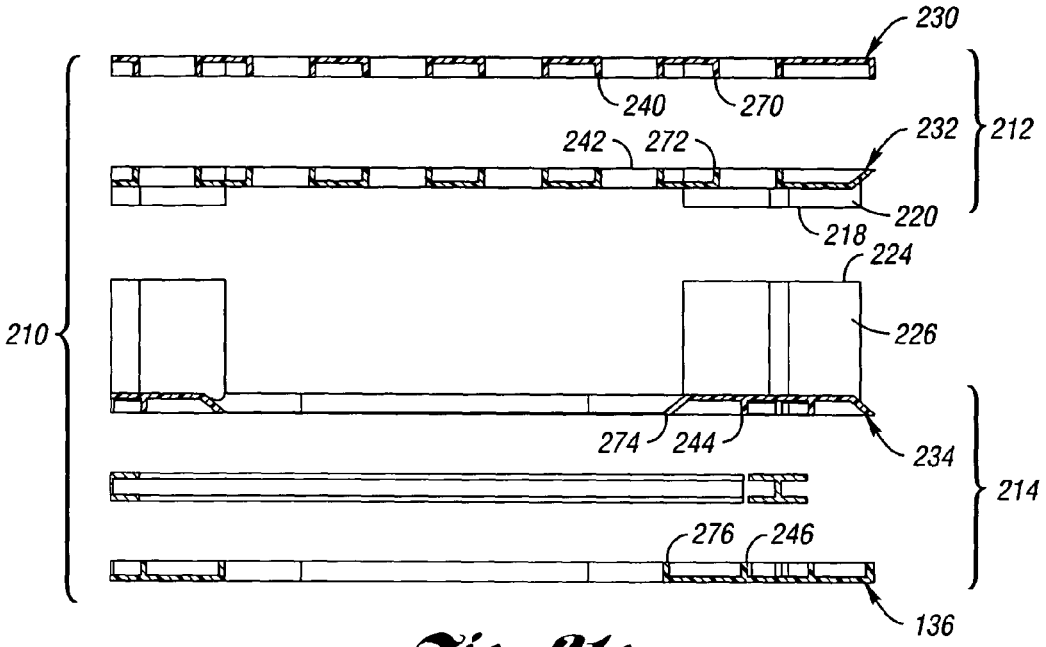
FIG. 31*a* is an exploded view of FIG. 31.
Figure 32B:
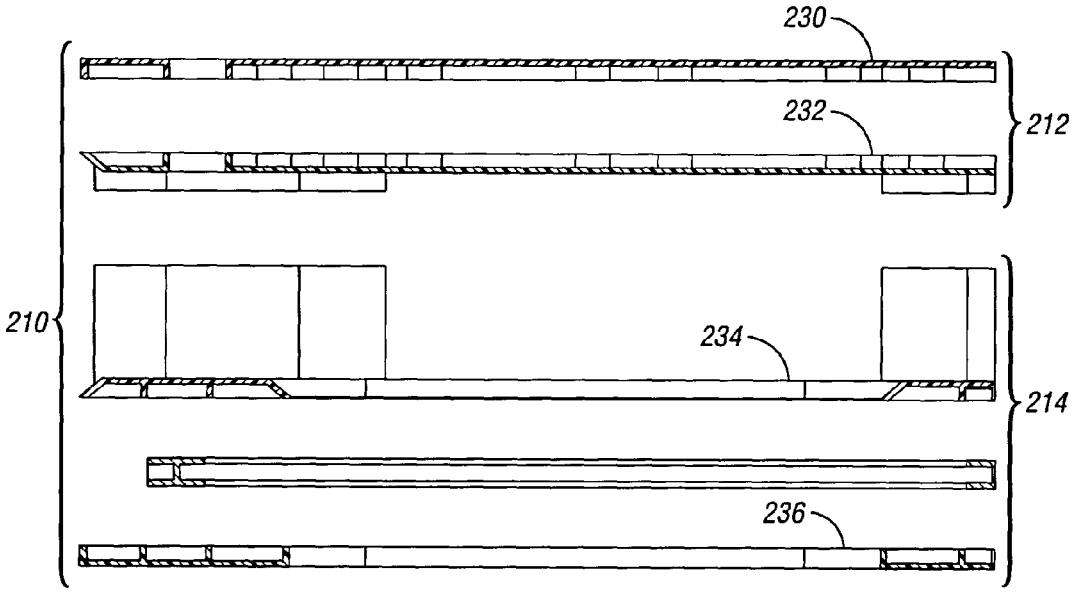
FIG. 32*b* is an exploded view of FIG. 32.
Figure 33:
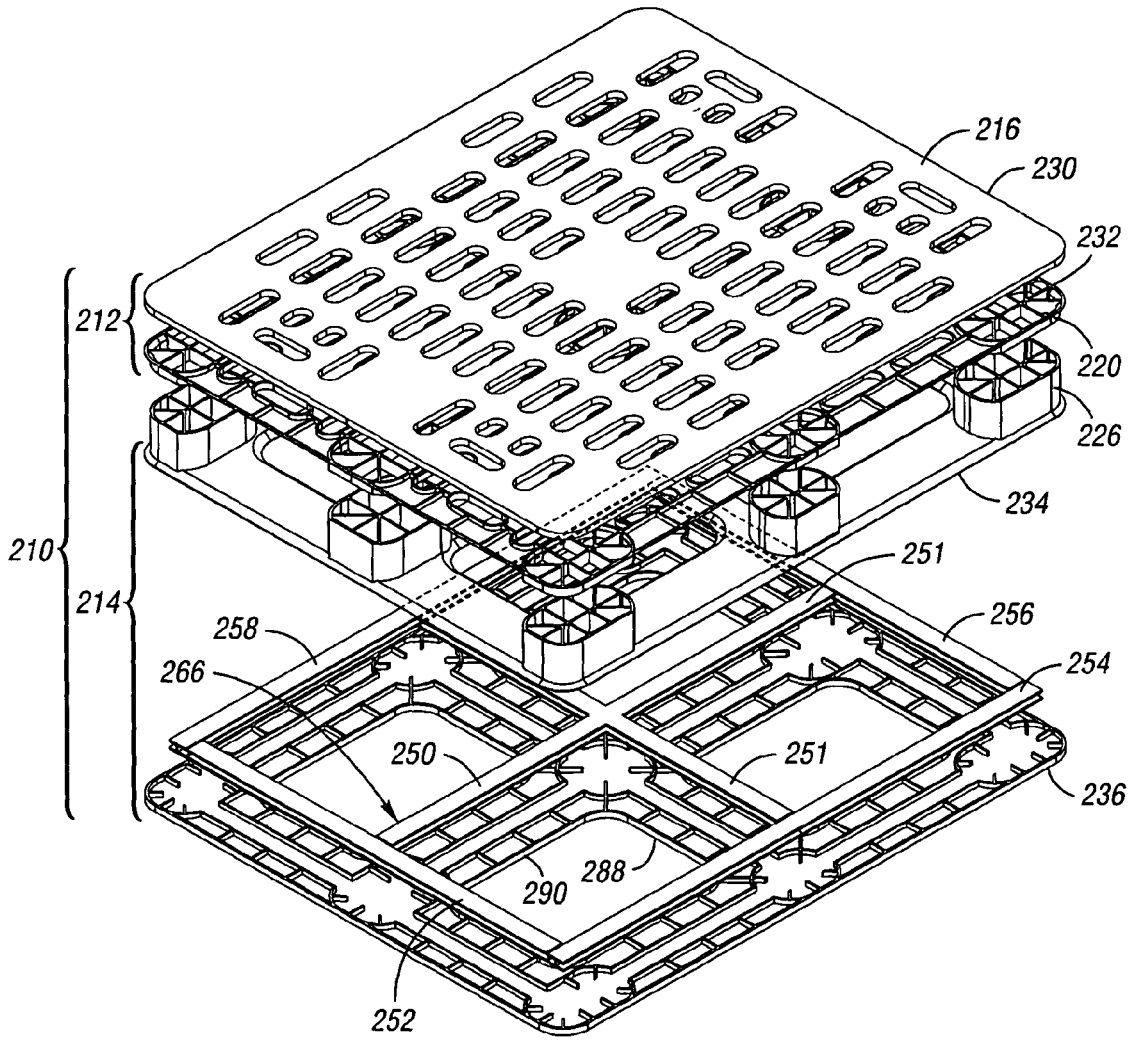
FIG. 33 is an exploded perspective view of FIG. 1, illustrating the reinforcement therein.
Figure 34:
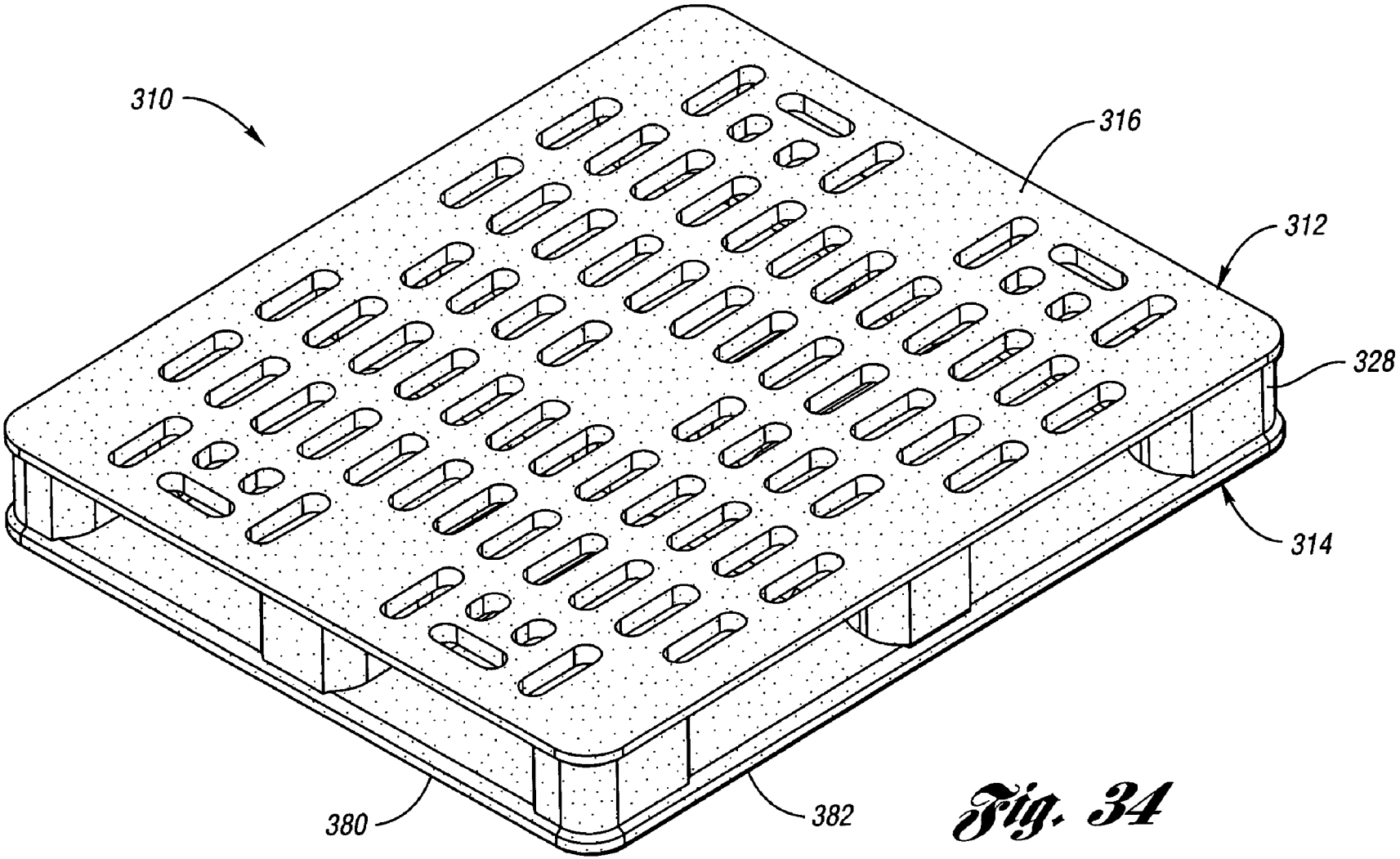
FIG. 34 is a perspective view of a fourth embodiment of a reinforced pallet according to the present invention.
Figure 35:
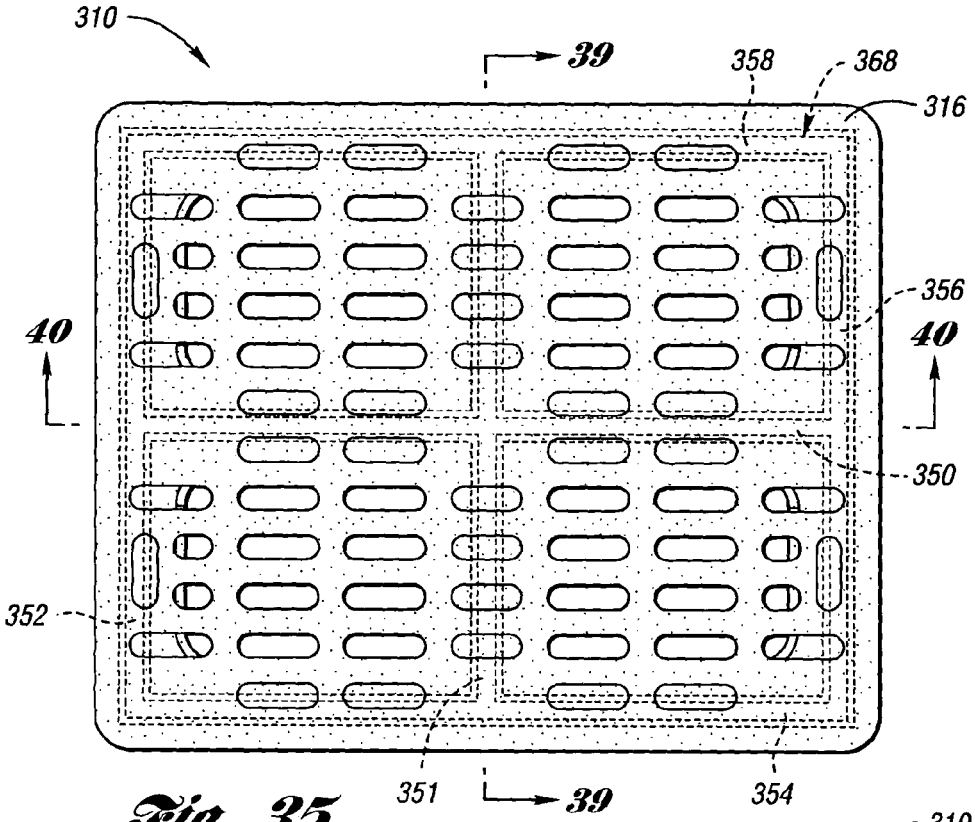
FIG. 35 is a top plan view of the fourth embodiment.
Figure 36:
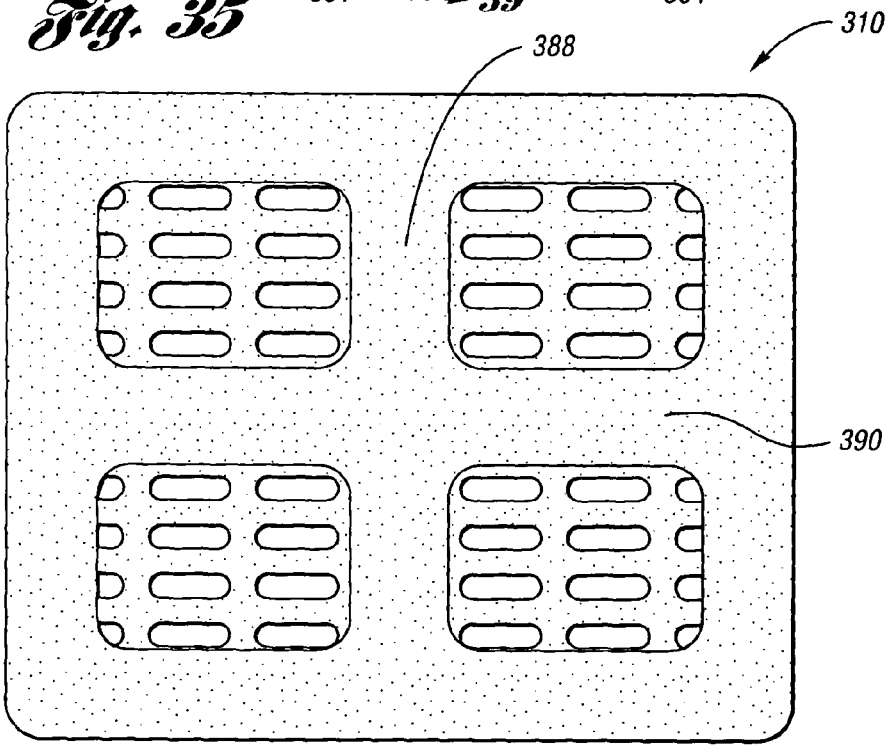
FIG. 36 is a bottom plan view of the fourth embodiment.
Figure 37:
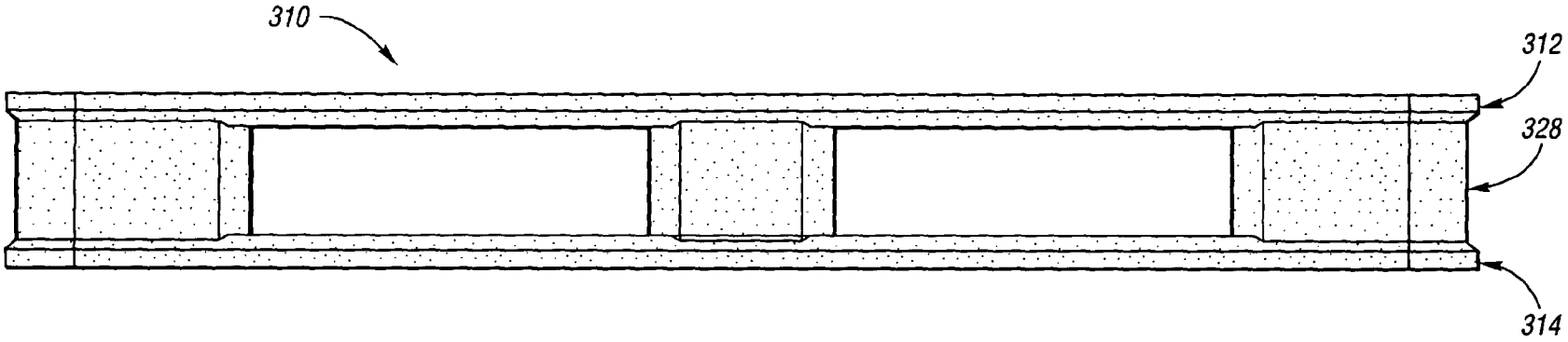
FIG. 37 is a front elevational view of the fourth embodiment, the rear elevational view being substantially a mirror image thereof.
Figure 38:
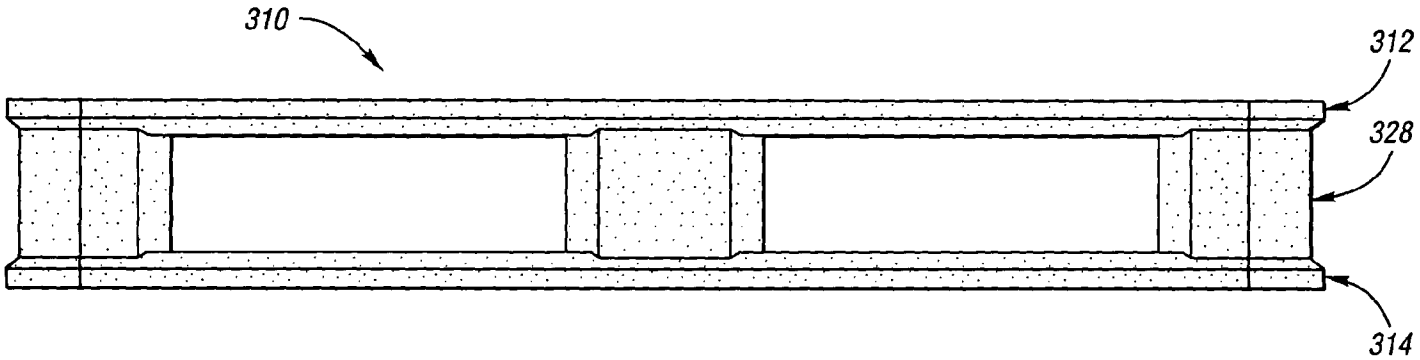
FIG. 38 is a left side elevational view of the fourth embodiment, the right side elevational view being substantially a mirror image thereof.
Figure 39:
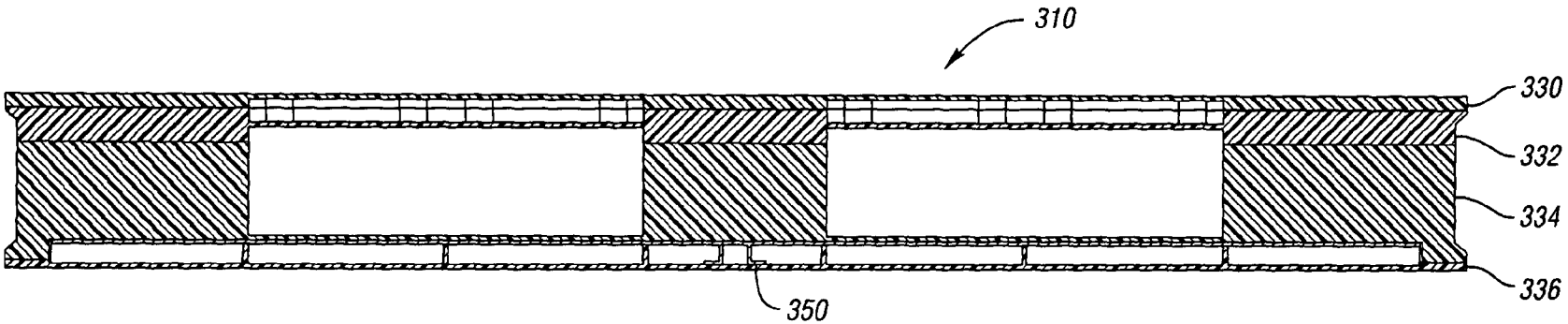
FIG. 39 is a cross-sectional view taken along line 39-39 of FIG. 35.
Figure 40:
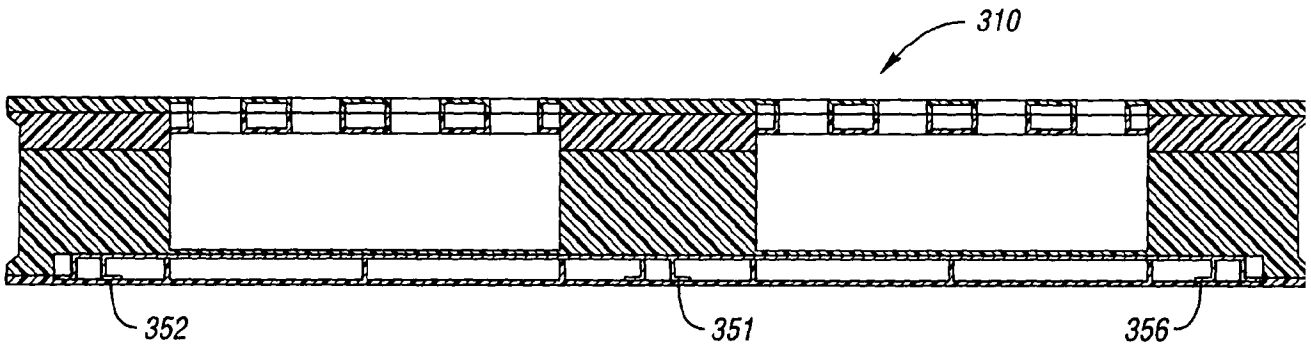
FIG. 40 is a cross-sectional view taken along line 40-40 of FIG. 35.
Figure 41:
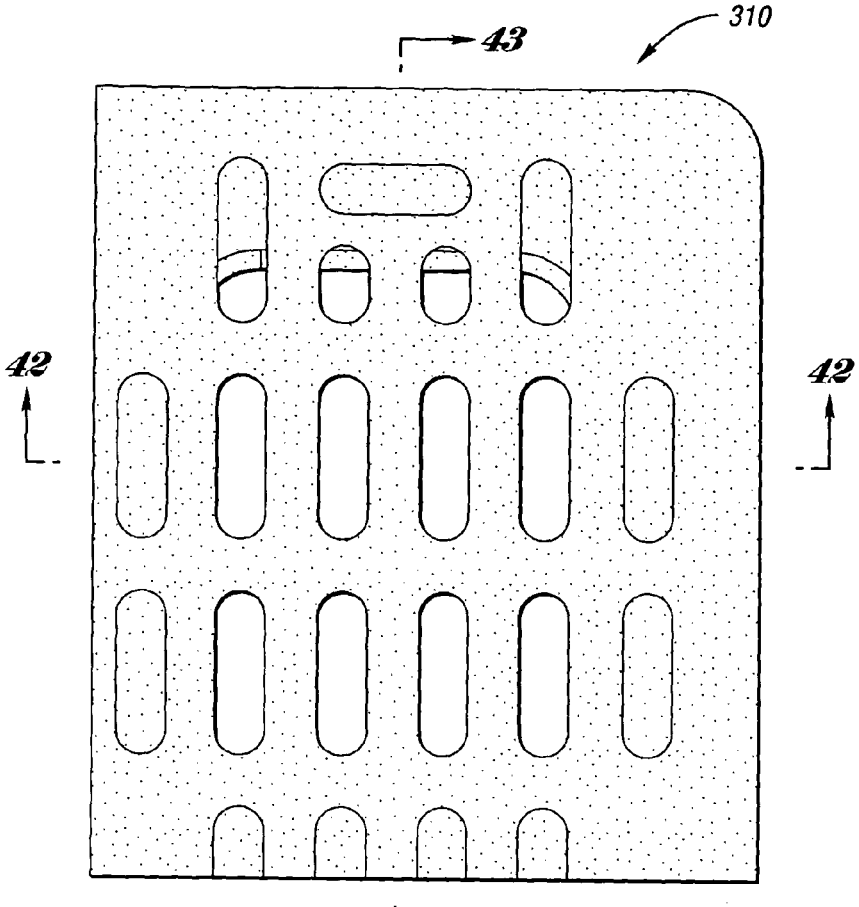
FIG. 41 is a quarter section of the fourth embodiment.
Figure 42:
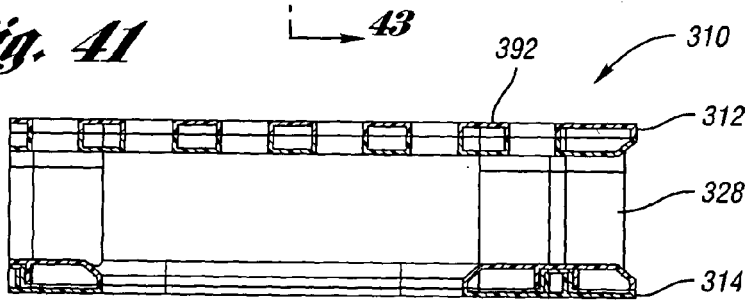
FIG. 42 is a cross-sectional view taken along line 42-42 of FIG. 41.
Figure 43:
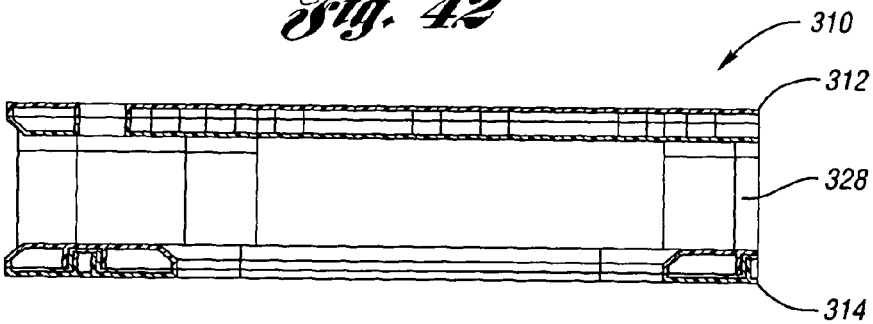
FIG. 43 is a cross-sectional view taken along line 43-43 of FIG. 41.
Figure 42A:
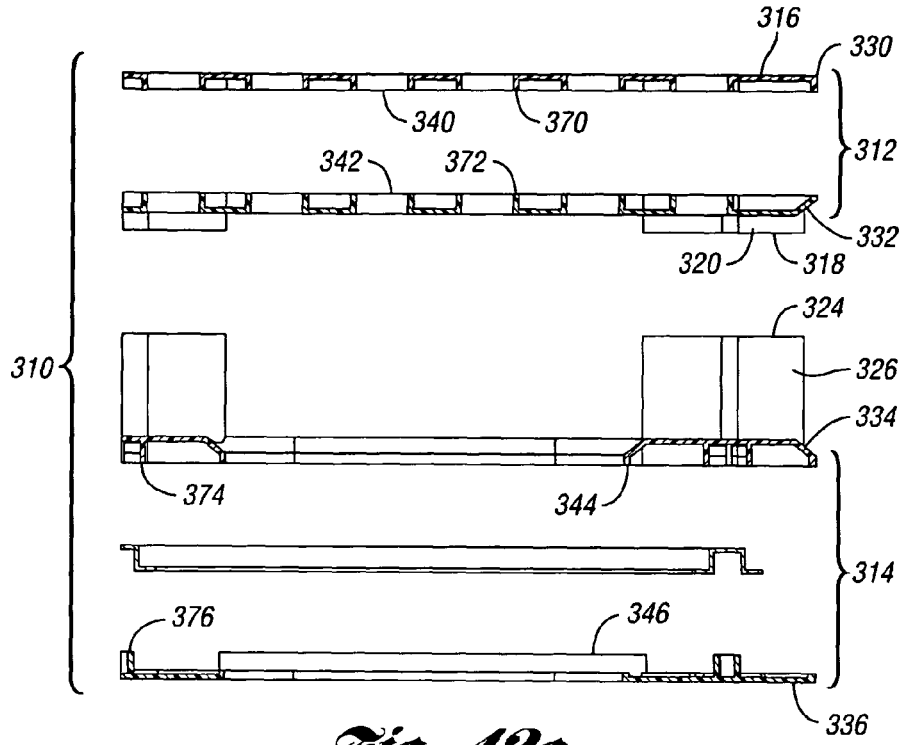
FIG. 42*a* is an exploded view of FIG. 42.
Figure 43A:
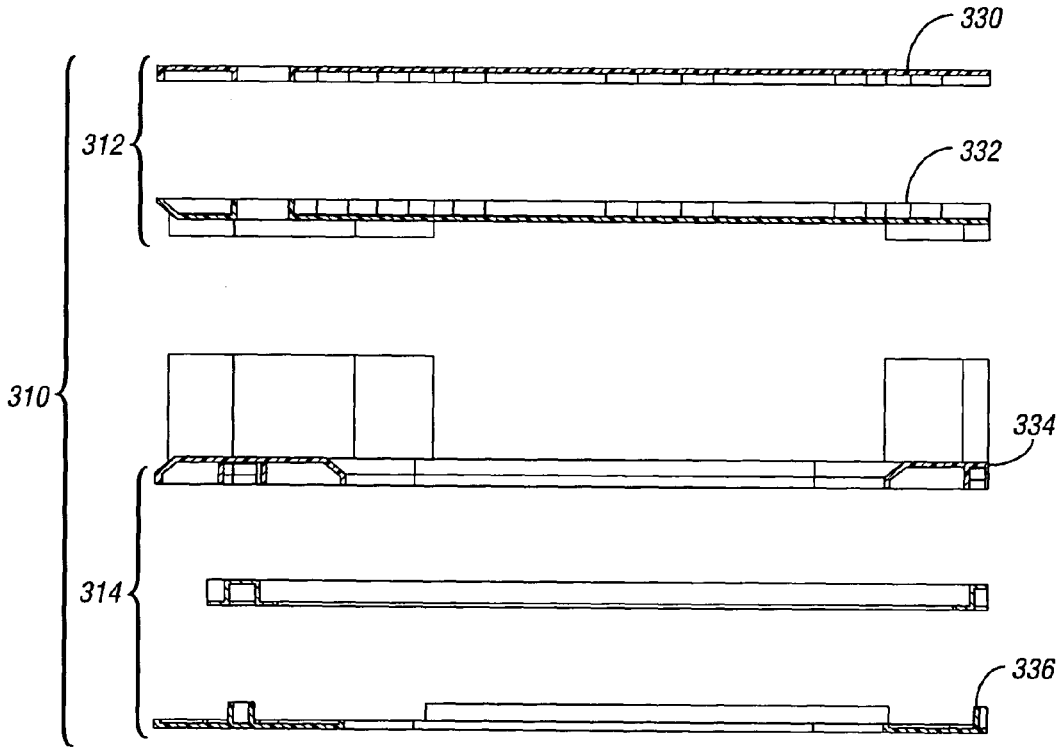
FIG. 43*a* is an exploded view of FIG. 43.
Figure 44:
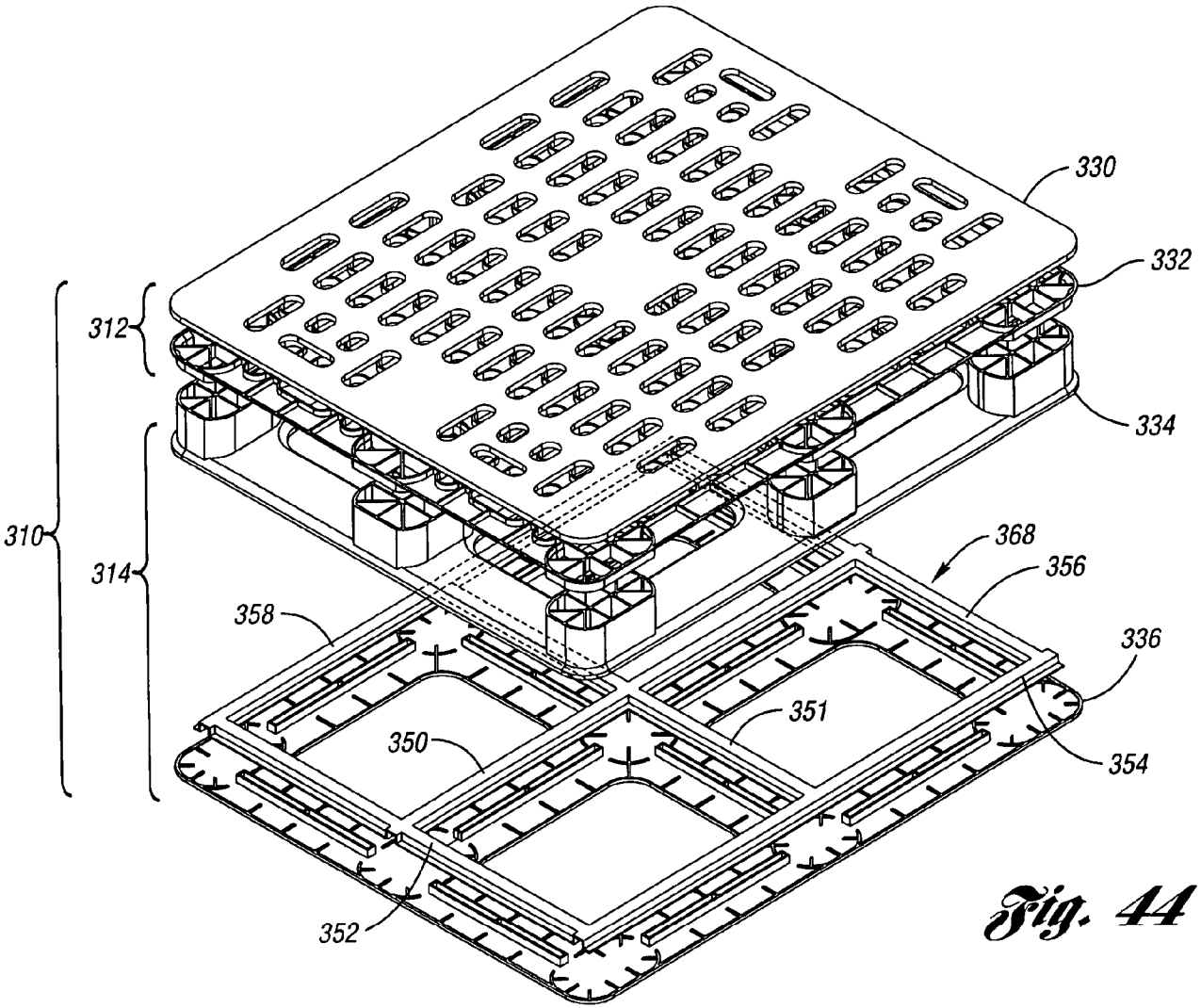
FIG. 44 is an exploded perspective view of FIG. 1, illustrating the reinforcement therein.
Figure 45:
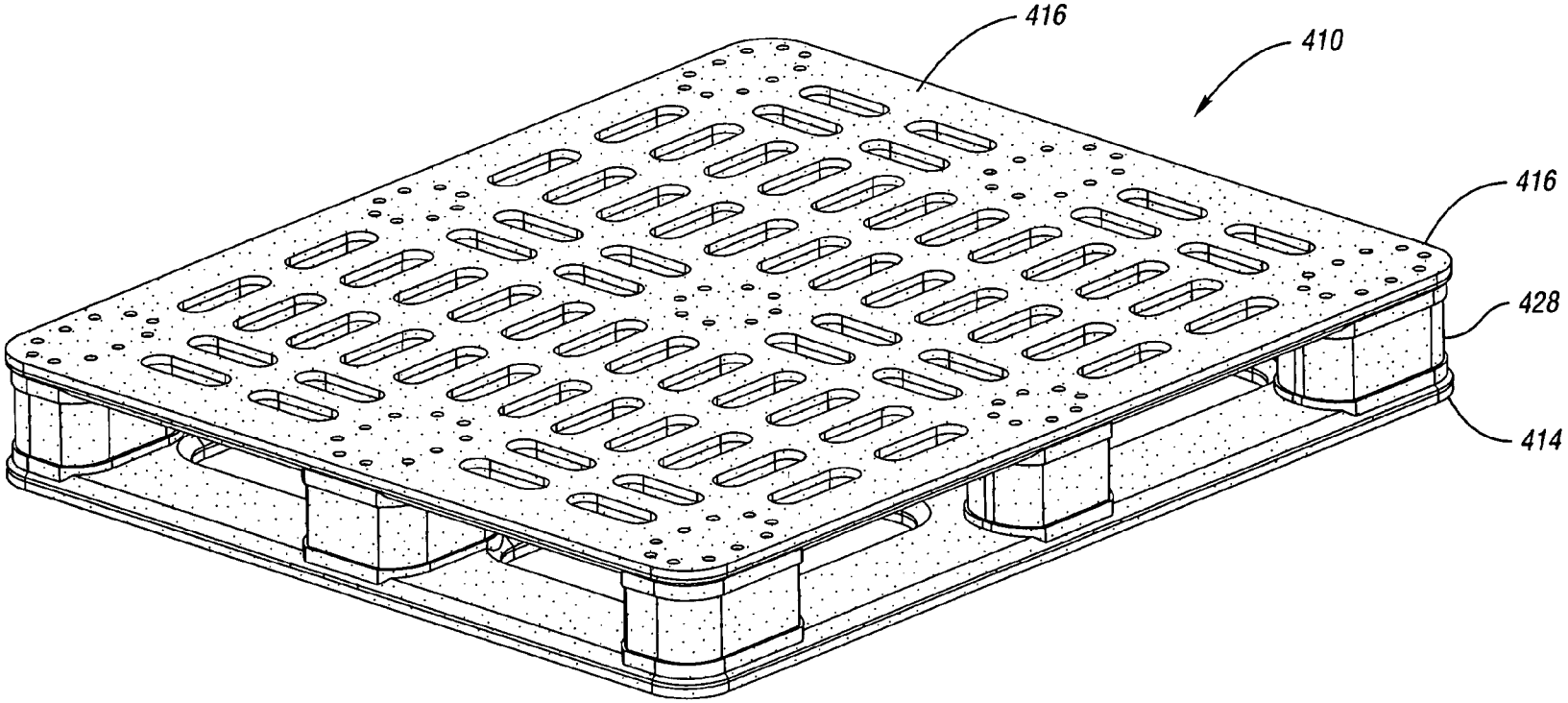
FIG. 45 is a perspective view of a fifth embodiment of a pallet according to the present invention.

With reference to FIGS. 9*a*, 10*a*, and 11, top deck 12 includes a first (top) portion 30 and a second (intermediate top or mid-top portion) portion 32, each having first mating surfaces 40, 42 which are securely attached to each other by any of various methods known in the art, such as plastic welding, i.e. hot plate welding, sonic welding, or infrared radiation. Bottom deck 14 includes a third (intermediate bottom or mid-bottom portion) portion 34 and a fourth (bottom) portion 36 which have corresponding second mating surfaces 44,46 which are securely attached to each other in a manner similar to top deck 12. The first mating surfaces 40, 42 are defined by a plurality of corresponding flange or ribbed members 70, 72. Second mating surfaces 44,46 are defined by a plurality of corresponding flange or ribbed members 74, 76, which are generally oriented in a multi-directional cross-ribbing orientation. With reference to FIGS. 1, 3 and 11, bottom deck 14 includes one or more relatively large openings 48 defined by a plurality of peripheral rail members 80, 82, 84, 86, as well as cross-rail members 88,90.

As best shown in FIG. 11, the bottom deck 14 also includes at least one cross-reinforcement member 50 which extends continuously across one of the longitudinal or transverse axes of bottom deck 14. For ease of reference, the axis along which cross reinforcement member 50 is disposed in bottom deck 14 will be referred to as the longitudinal axis.

Bottom deck 14 also preferably, but not necessarily, includes a plurality of peripheral elongate reinforcement members 52, 54, 56, 58 extending along the peripheral rails of bottom deck 14 for enhancing the strength, torsion, bending, and stiffness properties of pallet 10. Reinforcement members 30-38 of bottom deck 14 are particularly directed to providing reinforcement in the rack load and line load scenarios to which pallet 10 may be subjected. They are shown disposed in a generally planar orientation between mid-bottom member 34 and bottom member 36, such that the insert is sandwiched between adjacent mating surfaces 44 and 46, respectively. For example, as illustrated in FIG. 11, reinforcement members 52-58 are positioned within and extend along peripheral rails 80, 82, 84, 86.

Bottom member 36 has a pattern defined by ribs and cross-ribs, the pattern defining a corresponding recess or channel 78 into which reinforcement members 50-58 are received, such that when positioned, the reinforcement member(s) has a height similar to that of the surrounding ribbed structure, and the rib structure and the insert member are co-planar with surface 46. Accordingly, the reinforcements in bottom deck 14 do not increase the package height of this deck.

As illustrated in FIGS. 6, 9-9*a*, 10-10*a*, and 11, pallet 10 further includes a second cross-reinforcement 60 which is disposed within top deck 12, between first member 30 and second member 32. More particularly, second cross-reinforcement 60 is disposed along the transverse axis of top deck 12, which is in a plane parallel to but lies perpendicular to bottom deck cross-reinforcement 50. By including second cross-reinforcement member 60 within top deck 12 instead of bottom deck 14, many issues are addressed. First, in conjunction with bottom deck 14, this design provides pallet 10 with the desired rack loading strength. Second, both cross reinforcement members 50 and 60 are shown as continuous beams, which provides pallet 10 with the desired rack loading strength, while the line strength is enhanced by the peripheral reinforcement members. Moreover, by providing each cross-reinforcement member 50 and 60 in separate decks 12, 14, respectively, the desired package height of pallet 10 is able to be maintained, as opposed to a pallet which may have cross-reinforcement members on different vertical planes within a single deck. Accordingly, the design according to pallet 10 provides improved strength and packaging characteristics.

Accordingly, top deck reinforcement member 60 is disposed in the cross-member of top deck 12 which is oriented in a plane parallel to but along an axis perpendicular to the reinforced cross-member 50 of bottom deck 14. This orientation of reinforcement members in separate decks is more cost efficient than other embodiments, and will also satisfy the desired strength, line and rack loading strength, and bending characteristics.

Reinforcement members 50-58 may be formed of metal, such as stamped steel, aluminum, or may also be formed of a composite or structural plastic, such as a carbon-filled or glass-filled composite, or pultrusion. Of course, it is contemplated that there are numerous other materials which may provide the desired strength and loading properties and characteristics of pallet 10.

After reinforcement members are positioned on the desired rails, bottom and mid-bottom members 36, 38 are securely attached to each other. If attached by a welding process, mating ribbed surfaces 41, 43 of members 36,38 are heated to a point of plasticizing the plastic surfaces, and then are introduced to each other and held together for a period of time by which a welded bond will form between the surfaces. In those areas, the attachment of intermediate bottom member 34 to bottom member 36 (i.e. welding, etc.) takes place between the mating ribs of those areas not covered by reinforcement member 50 as well as the mating flanged edges of members 34,36. Deck portions 32, 34 of top deck 12 are similarly attached.

Figure 9:
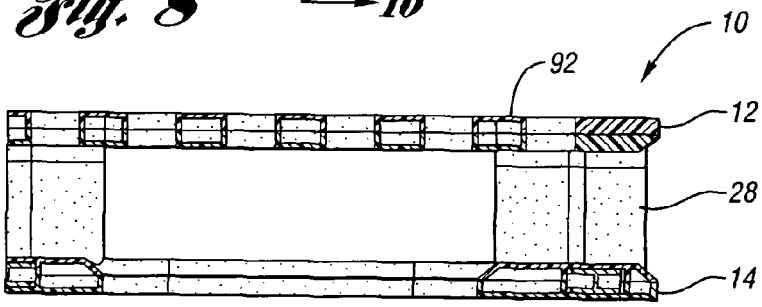
FIG. 9 is a cross-sectional view taken along line 9-9 of FIG. 8.

FIGS. 9-10 show a partial cross-sectional view of a quarter of pallet 10 having reinforcement members 50-60 which have an I-beam cross-section. Of course, it is fully contemplated that the reinforcement members are not limited to that cross-section shown. Instead, the cross-section of reinforcement members is illustrated by way of example and not limitation, and it is fully contemplated that the reinforcement members 50-60 disclosed herein may have any number of cross-sectional designs and configurations, the selection of which may be chosen based on the desired application, cost, availability, and properties of pallet 10 in accordance with the teachings herein. For example, the fourth embodiment disclosed herein in association with FIGS. 33-44 includes reinforcement members having an inverted U-shaped cross-section.

FIGS. 9 and 10 illustrate that joining together each of the above respective pairs of mating ribs and a pattern of cross-ribbing (both continuous and non-continuous across the pallet decks) which are aligned to define a plurality of box-beam sections 92 across one or both of pallet decks 12, 14, and particularly in those areas which do not include reinforcement members. Mating planar surfaces 18, 24 of decks 12, 14 which form columns 28 between the decks may also define box beam sections. The box-beam sections may be interrupted by flow-through holes 13 or handles 15 without departing from the teachings herein. It is also noted that the reinforcement members herein are preferably fully enclosed within their respective decks 12, 14, with little or no exposure to the environment. Pallet 10 thus provides improved racking and line loading strength, as well as overall deflection, bending, and stability characteristics.

Second Embodiment

FIGS. 12-22 illustrate a pallet 110 according to a second embodiment of the present invention. Components similar to those of the first embodiment have a corresponding reference number with a "1" prefix. Pallet 110 is similar to pallet 10, but has a bottom deck 114 with a single cross-rail 188 having therein a first continuous cross-reinforcement member 150. Because the single cross-rail bottom deck design may have relatively lower bending and torsional strength compared to the first embodiment, additional top deck 112 reinforcement may be necessary. Accordingly, pallet 110 includes a pair of continuous cross-reinforcement members 160, 161 which lie in the transverse axis of top deck 112, as well as a pair of opposed peripheral reinforcement members 162, 164 proximate sides of top deck 112. Again, because pallet 110 includes one or more reinforcement members in top deck 112, the strength of pallet 110 is increased without increasing the thickness of the resulting pallet.

Third Embodiment

A third embodiment of according to the present invention is illustrated in FIGS. 23-33 as pallet 210, which includes top deck 212 and bottom deck 214. Components similar to those of the first embodiment have a corresponding reference number with a "2" prefix. Pallet 210 includes a plurality of peripheral reinforcement members 252, 254, 256, 258, and an integral formed cross-member 266 formed as unitary member with co-planar first and second cross-reinforcements 250 and 251. This unitary, continuous reinforcement 266 across bottom deck has sufficient strength characteristics such that no reinforcement may be necessary in top deck 212. While reinforcement could be added to top deck 212, this would increase the cost and weight of pallet 210.

In accordance with the teachings according to the present invention, such unitary cross-member 266 is preferable to a multi-piece, non-continuous, co-planar cross reinforcements within a single deck, and also to reinforcement members on parallel planes within a single deck, both of which may not provide the desired racking load strength and/or package height.

Adding a separate reinforcement cross-portion across the remaining reinforcement cross member would require at least a portion (in the central region where they cross) of the reinforcement members to lie in separate planes. Thus, a center reinforcement which crosses may not be feasible.

Fourth Embodiment

A fourth embodiment according to the present invention is shown in FIGS. 33-44 as pallet 310. Components similar to those of the first embodiment have a corresponding reference number with a "3" prefix. In this embodiment, note that bottom deck 314 includes an integrally formed, unitary reinforcement member 368, including cross-member portions 350, 351, as well as peripheral reinforcements 352, 354, 356, 358, which are generally continuous, and also generally has an inverted U-shaped cross-section. As with the third embodiment, the overall continuous nature of reinforcement member 368 within bottom deck 314 provides pallet 310 with the desired strength, as well as the desired line load and rack loading strength, and torsional strength. However, member 368 may be relatively more costly to manufacture.

Fifth Embodiment

Figure 2:
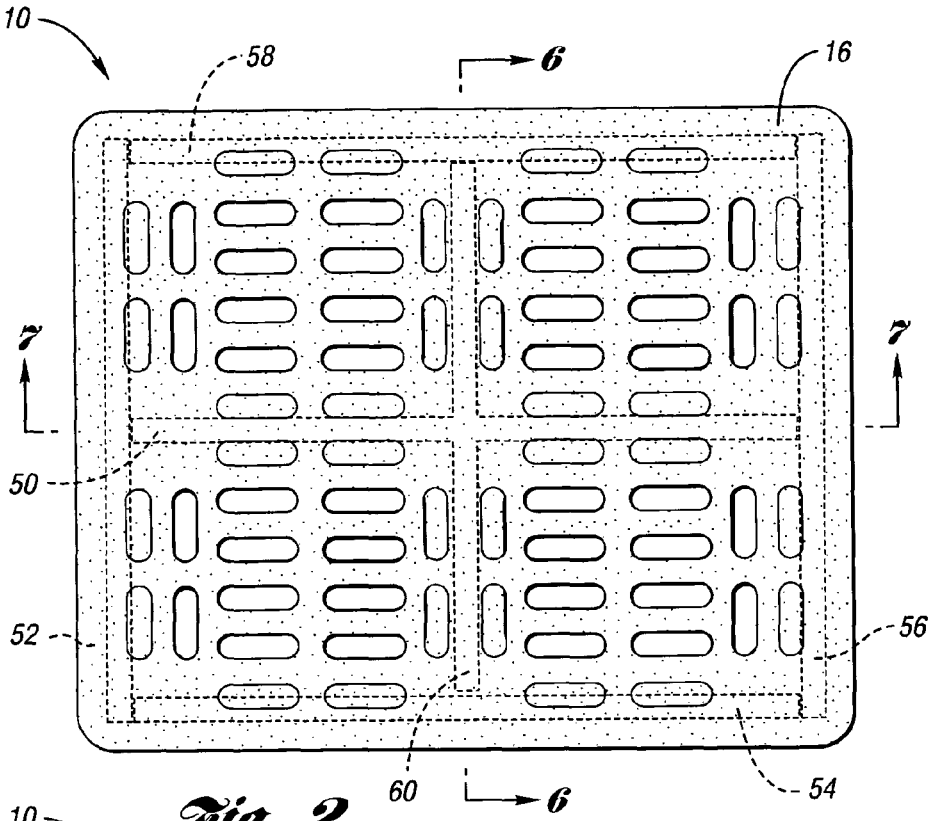
FIG. 2 is a top plan view of the first embodiment.

A pallet assembly according to the present invention is illustrated in FIGS. 1-2 as pallet assembly 410. Pallet assembly 410 includes the following: a top deck 412 having a top portion 430 and a mid-top portion 432; a bottom deck 414 having a mid-bottom portion 434 and a bottom portion 436; and a plurality of column members 428.

While pallet assembly 410 may be used in the same environments as other pallets disclosed herein, it is particularly well-suited to a pallet assembly which seeks to enhance the properties of its individual components, and doing so in a cost efficient manner when feasible. For example, due to their positioning within pallet 410, column members 428 are subject to repeated impact by fork lift tines. Thus, in a preferred embodiment, columns 428 may be molded from a plastic material or composite that provides high impact resistance. Upper and lower decks 412, 414 on the other hand may not require a high impact resistant material, but instead may be formed of a material that has relatively high friction coefficient, high stiffness, high fire retardant characteristics (one which improves the burning and suppression characteristics) properties of the pallet.

With regard to the burn and suppression characteristics of a pallet, the present invention teaches that the horizontal surfaces of a pallet (i.e. the decks), and particularly the underside of the decks, have a greater exposure to flame during burn as flames are traveling upwards, and thus have a relatively greater influence on the pallet burn rate than the vertical surfaces of a pallet (i.e. the columns). Accordingly, for a pallet seeking to incorporate fire retardant material into its design in an effective and cost efficient manner, it is unexpectedly taught herein that the entire pallet does not need to be formed of fire retardant material, but instead selected components may be formed thereof. One embodiment according to the present invention teaches that the horizontal portions of the pallet have a predetermine level of fire retardance, while the vertical portions have minimal or no fire retardance, and in any event less than the horizontal portions. Thus, in keeping with these teachings, the decks 412, 414 (the horizontal surfaces) of pallet 410 are formed of a polymeric material having a fire retardant properties, typically by including a fire retardant resin or additive to a plastic carrier, thereby defining a predetermined level of flame retardance. On the other hand, the columns 428 (the vertical surfaces) may be formed separately from a high impact material or other type of polymer material which also has little or no flame retardance, and thus has a predetermined level of flame retardant which is less than decks 412, 414.

Figure 47:
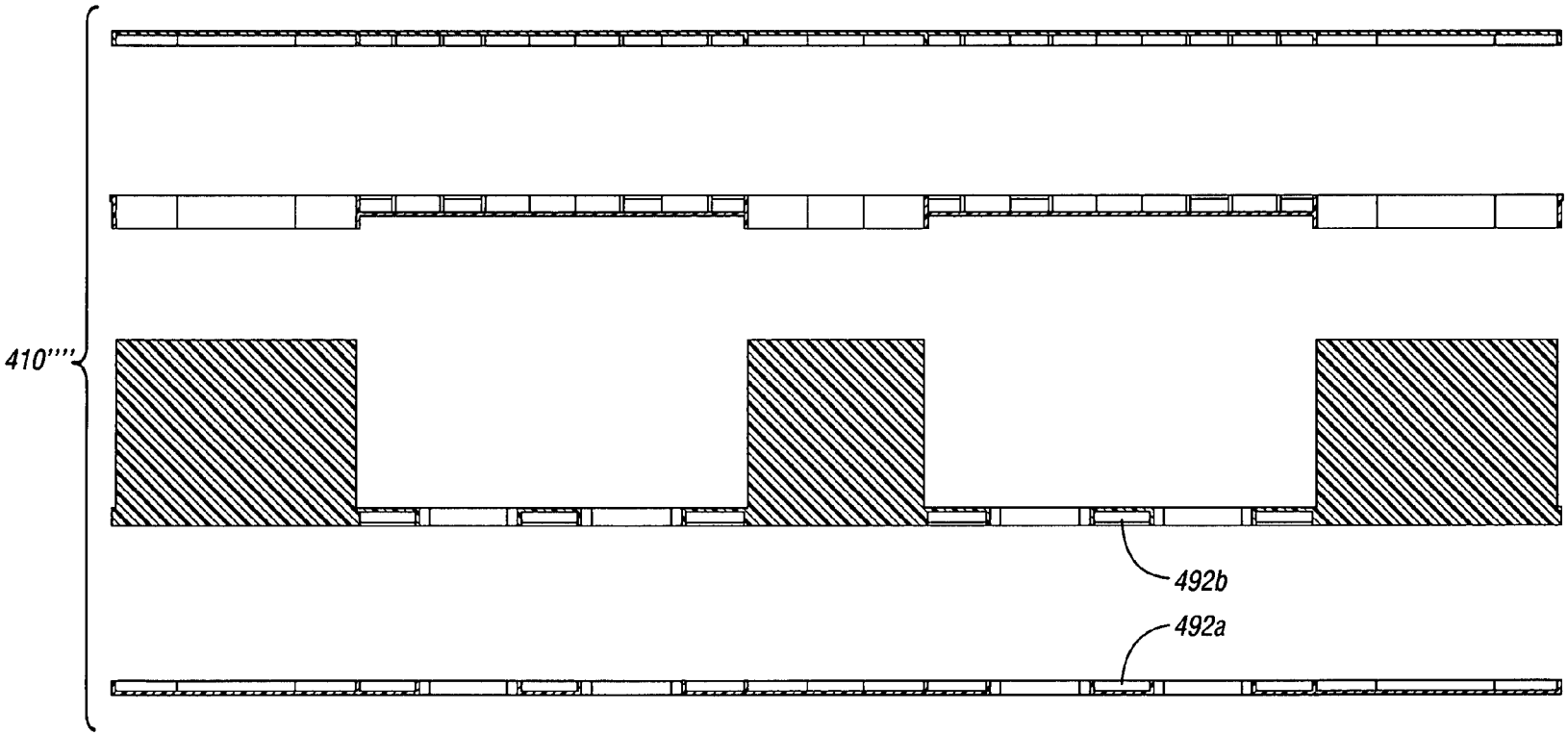
FIG. 47 is an exploded cross-sectional view of an alternate fifth embodiment.

More particularly, for one deck pallets and two deck pallets, the present invention further teaches that the upper horizontal portion of a pallet (i.e. the top deck components) has the greatest affect on the burn rate of a pallet than the other portions of the pallet. Accordingly, in keeping with the teachings according to the present invention, top deck 412 of pallet 410 is formed of a plastic material having a predetermined level of flame retardance, while the columns 428 and lower horizontal surfaces (the bottom deck 414) may be formed separately from a high impact material or other type of polymer material which has little or no flame retardant material, and in any event has less than top deck 412. In such an embodiment, the columns may be integrally formed with the bottom deck of the same material (FIG. 47).

In a pallet having multiple deck portions, the present invention further teaches that the horizontal lower portion of each deck has a greater affect on the burn and suppression rate of a pallet than the other deck portions and column portions. Thus, in a preferred embodiment, mid-top portion 432 and bottom portion 436 of pallet 410 are formed of a plastic material each having a predetermined level of flame retardance which is higher than that of the remaining components of the pallet. Again, the remaining components may be little or no fire retardance properties.

Even more particularly for pallets having multiple deck portions, in a more preferred embodiment, it is taught herein that the horizontal lower portion of the top deck has the greatest affect on the burn rate of a pallet and therefore requires a higher level of fire suppression than the other pallet components. Accordingly, mid-top portion 432 has a predetermined level of flame retardance which is higher than that of the remaining components of the pallet. In such an embodiment, the columns may be integrally formed with the mid-bottom deck portion of the same material (FIG. 47.)

As in previous embodiments, pallet assembly 410 also includes reinforcement members therein. Bottom deck 414 includes a cross-reinforcement member 450 and peripheral reinforcement members 452, 454, 456, 458. Top deck 412 includes a cross-reinforcement member 460 which lies in a plane parallel to but along an axis perpendicular to that of reinforcement member 450.

Joining the pallet components to each other may be performed by means known to those in the art. For example, the columns may be press fit into the decks, or may be snapped together into the decks by a snap attachment (one type is shown in U.S. Pat. No. 6,006,677). The parts may also be welded via a welding for dissimilar materials.

Thus, this pallet embodiment allows only those desired components to be formed from an fire retardant material, such that the pallet may have the desired fire retardant, and burn and suppression characteristics. This pallet also allows the manufacturer the freedom to selectively control and allocate the material and/or amount of fire retardant additive in each component. Accordingly, this provides a lower cost pallet, since the entire pallet no longer needs to be formed of a single material, particularly a more costly single fire retardant material. Accordingly, the desired fire retardant levels for each pallet component and for the overall pallet may be achieved for obtaining desired pallet burn and suppression characteristics in a cost efficient manner, so that the pallet disclosed herein may meet the industry specifications, such as those outlined by, and including but not limited to, NFPA 13, FMRC 4995, and UL 2335, incorporated herein by reference. Thus, the fire retardant additives may be adjusted such that the pallet as a whole meets the desired guidelines. Particularly, the burn and suppression characteristics should be substantially equivalent or better than a similarly sized wood pallet, such as one made from hard wood. Accordingly, the pallet should have a fire rating and burn rate no higher than wood. The particular materials used may be those known in the art for producing fire retardant characteristics in pallets, including but not limited to commodity items, such as polymer resins like polyolefins having a halogen based flame retardant resin additive.

Figure 46:
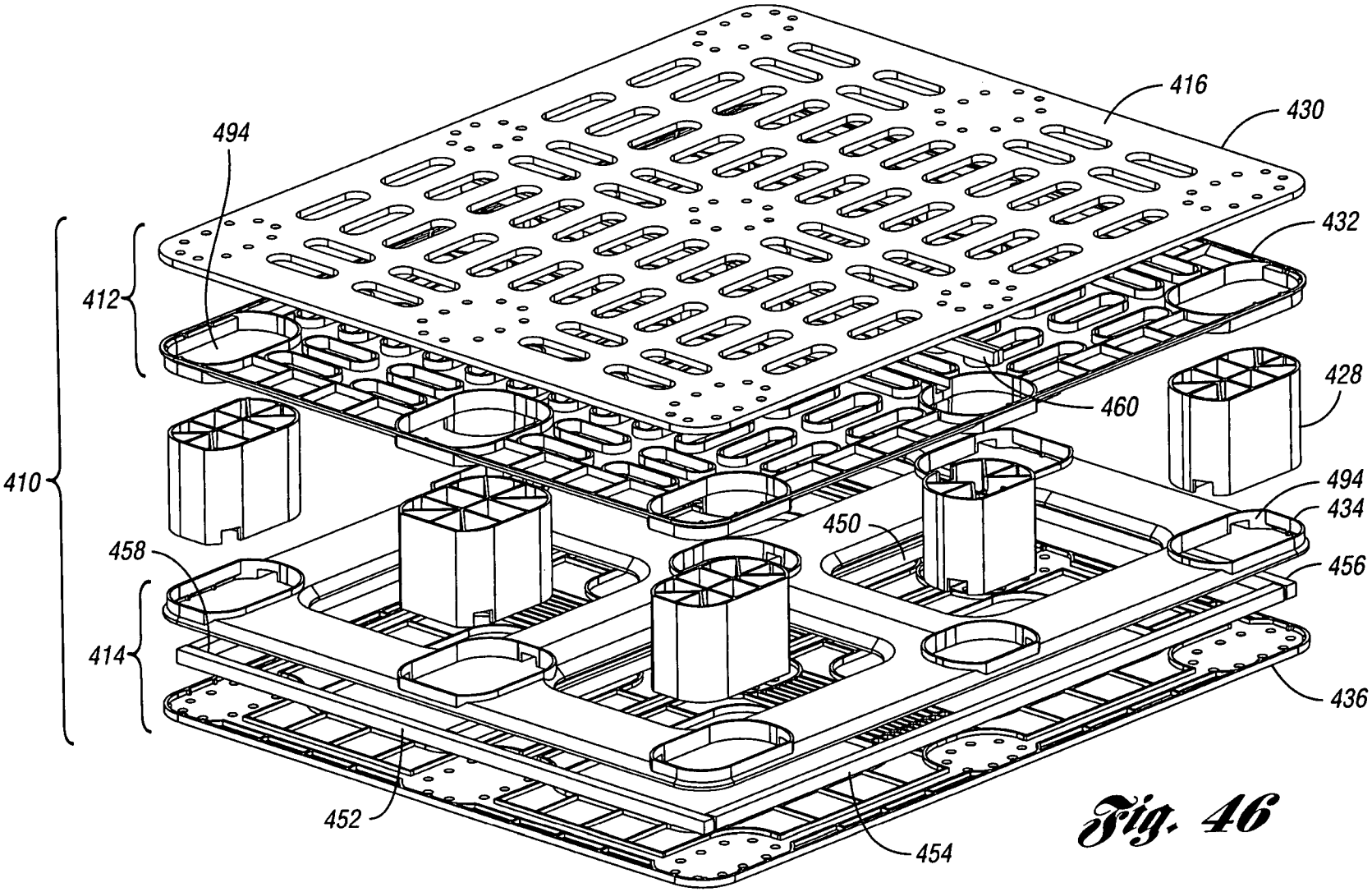
FIG. 46 is an exploded perspective view of the fifth embodiment.
Figure 46A:
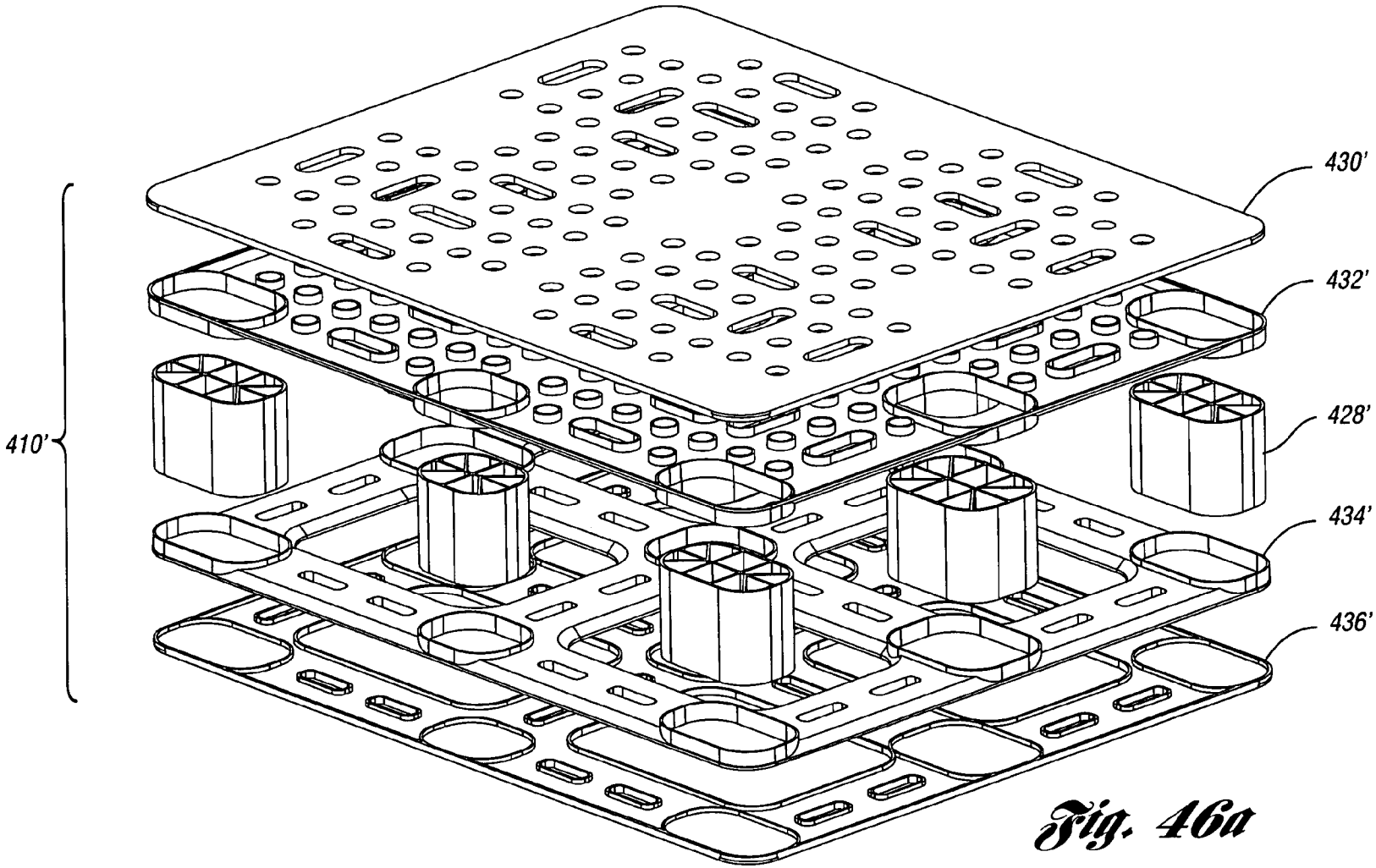
FIGS. 46*a, b* and *c*, are alternate exploded views of the fifth embodiment.
Figure 46B:
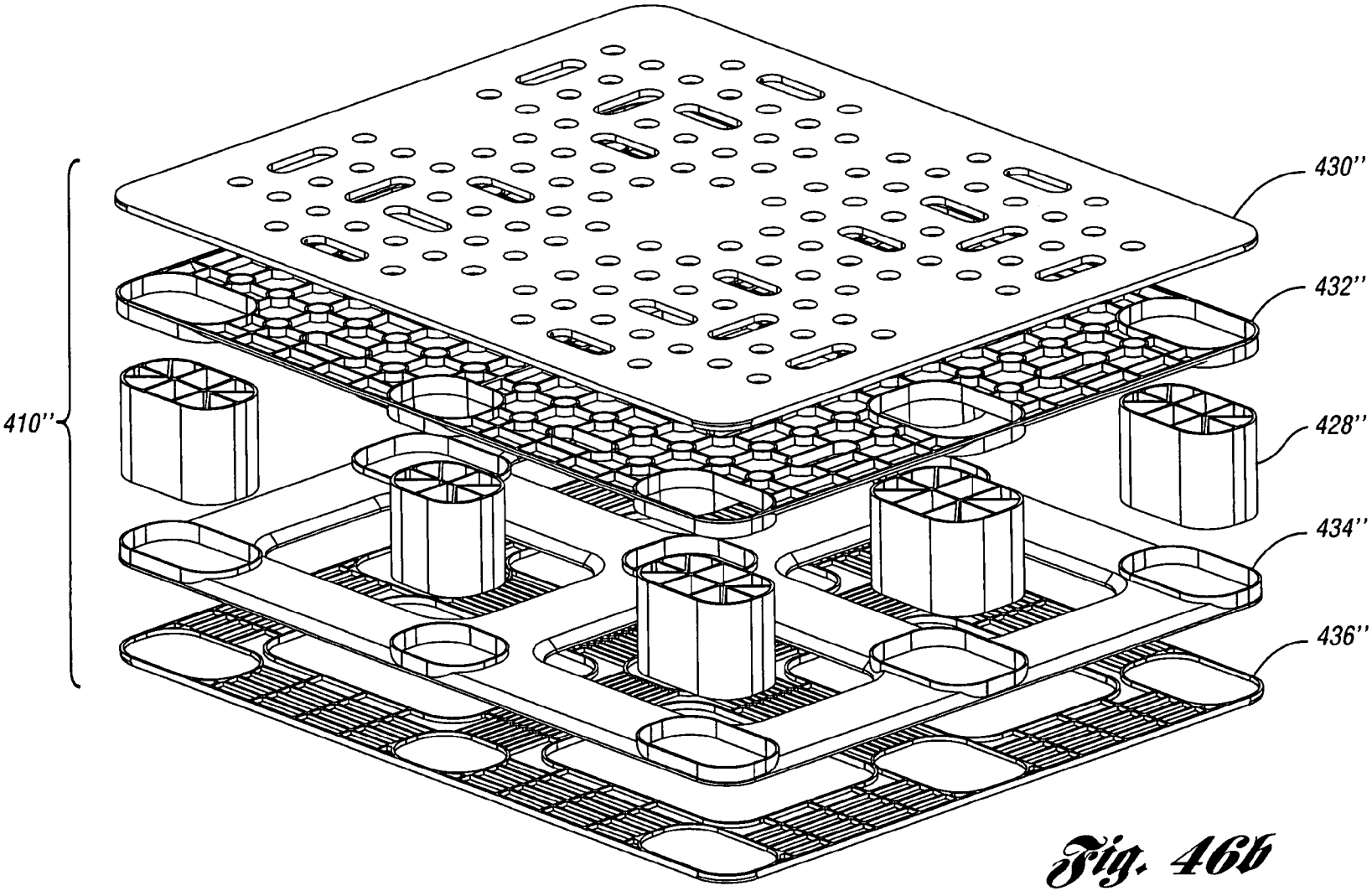
Figure 46C:
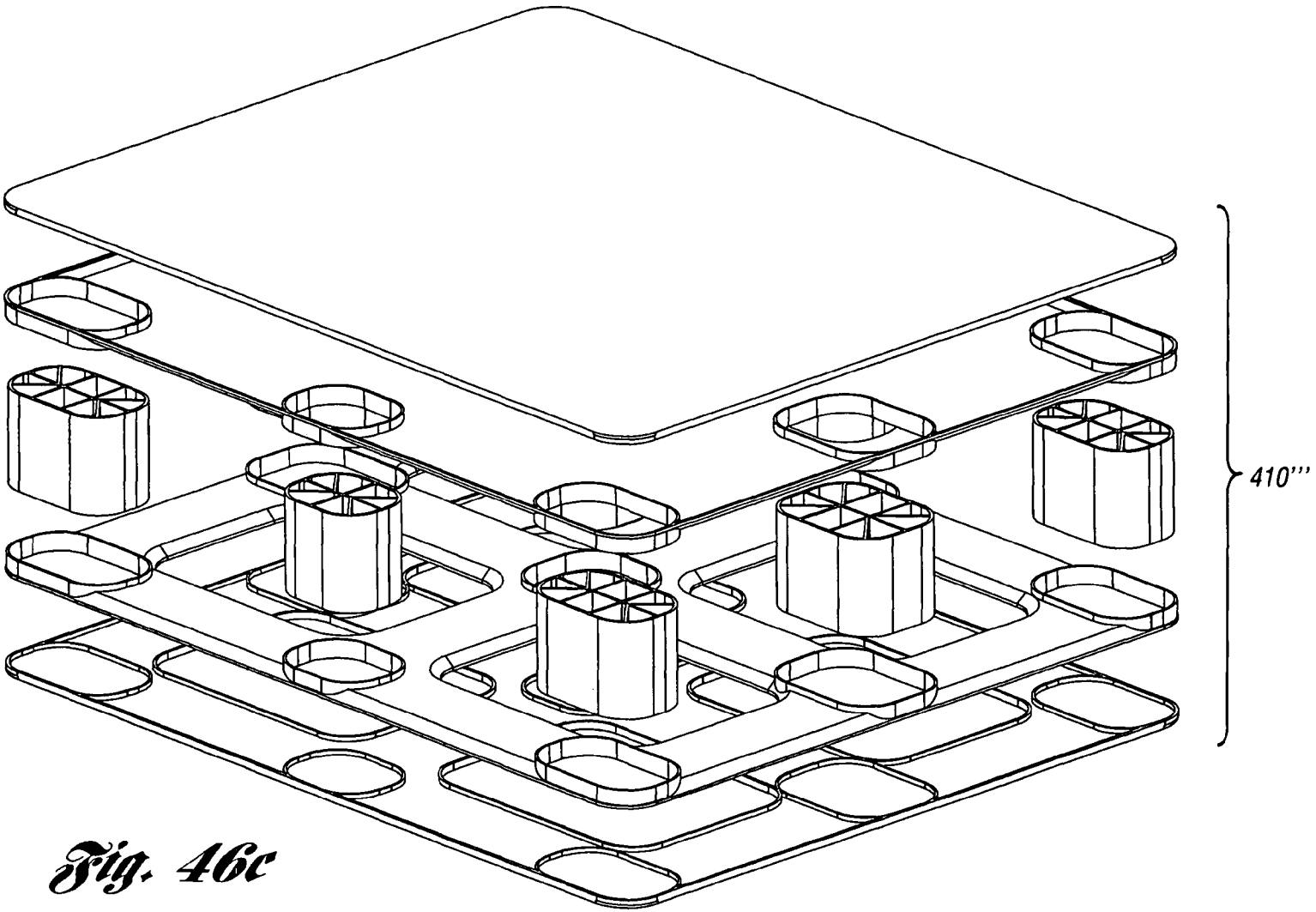

Of course, as illustrated herein, these teachings are applicable to pallets of any size, design, and to those manufactured by various processes. By way of example and not limitation, the teachings herein may also apply to reinforced pallets (FIG. 46) or to pallets without additional reinforcement in the top and/or bottom decks (FIGS. 46*a*, 46*b*, 46*c*). The teachings may also apply to pallets having internal ribbing, cross-ribbing, and box-beams 492*a,b* (FIG. 47), or to pallets without (FIG. 46*c*). They are applicable to one deck pallets, two deck pallets, and pallets formed from multiple deck portions. Because some fire retardant additives may cause some polymer carriers to lose some stiffness, the teachings herein are particularly applicable to reinforced pallets.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A reinforced pallet comprising:

a first deck portion having a first sheet portion and a first plurality of rib members extending therefrom;

a second deck portion having second sheet portion a second plurality of rib members extending therefrom, the second plurality of rib members mating with corresponding first plurality of rib members to form a first pallet deck, the second deck portion including a plurality of first support members protruding from the second sheet portion;

at least one elongate reinforcement member disposed between the first and second deck portions; and a third deck portion having third sheet portion with a first surface and an opposite second surface, a plurality of second support members protruding from the first surface of the third sheet portion, a third plurality of rib members protruding from the second surface of the third sheet portion, the second support members connected to the first support members to define columns spacing the second deck portion from the third deck portion.

2. The reinforced pallet assembly of claim 1, wherein the first deck portion, the second deck portion and the first support members are plastic and wherein the at least one reinforcement member is metal.

3. The reinforced pallet assembly of claim 2 wherein the at least one reinforcement member includes a plurality of reinforcement members.

4. The reinforced pallet assembly of claim 1 wherein the at least one reinforcement member includes a first reinforcement member and a second reinforcement member perpendicular to the first reinforcement member.

5. The reinforced pallet assembly of claim 1 wherein the first plurality of rib members are cross-ribs and wherein the second plurality of rib members are cross-ribs.

6. A reinforced pallet comprising:

a first deck having an upper surface, a lower surface, and a plurality of box beam sections disposed between the upper surface and the lower surface;

at least one elongate reinforcement member disposed in at least one of the plurality of box beam sections;

a plurality of first column portions extending from the first deck; and a second deck having a sheet portion and a plurality of second column portions protruding from the sheet portion to the first column portions, a plurality of ribs extending from the sheet portion in a direction opposite the second column portions.

7. The reinforced pallet of claim 6 wherein the at least one reinforcement member includes a plurality of reinforcement members.

8. The reinforced pallet 7 wherein the plurality of reinforcement members are connected to one another.

9. The reinforced pallet of claim 6 wherein the plurality of box beam sections are a first plurality of box beam sections, and wherein the second deck includes an upper surface and a lower surface, a second plurality of box beam sections disposed between the upper surface and the lower surface of the second deck.

10. A reinforced pallet comprising:

an upper planar member having an upper surface and a lower surface;

a lower planar member having an upper surface and a lower surface, a plurality of rib members extending between the lower surface of the upper planar member and the upper surface of the lower planar member;

a plurality of first support members extending from the lower surface of the lower planar member;

at least one elongate reinforcement member disposed between the first and second deck portions and between the rib members; and a deck member having a deck planar member from which a plurality of second support members extend and are connected to the plurality of first support members, the deck member further including a plurality of rib members extending from the deck planar member in a direction opposite the plurality of second support members.

11. The reinforced pallet of claim 10 wherein the at least one reinforcement member includes a first reinforcement member and a second reinforcement member.

12. The reinforced pallet of claim 11 wherein the first reinforcement member is connected to the second reinforcement member.

* * * * *